US009471031B2

(12) United States Patent
Kusano et al.

(10) Patent No.: US 9,471,031 B2
(45) Date of Patent: Oct. 18, 2016

(54) IMAGE FORMING APPARATUS WITH SEPARATE SUPPORT MEMBERS FOR REMOVABLE CARTRIDGES

(71) Applicant: CANON KABUSHIKI KAISHA, Tokyo (JP)

(72) Inventors: Yohei Kusano, Numazu (JP); Noriyuki Komatsu, Numazu (JP); Tetsuya Numata, Suntou-gun (JP); Osamu Anan, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/718,861

(22) Filed: May 21, 2015

(65) Prior Publication Data

US 2015/0346679 A1 Dec. 3, 2015

(30) Foreign Application Priority Data

May 29, 2014 (JP) ..... 2014-110758
Apr. 21, 2015 (JP) ..... 2015-086632

(51) Int. Cl.
*G03G 21/16* (2006.01)
*G03G 21/18* (2006.01)

(52) U.S. Cl.
CPC ..... *G03G 21/1661* (2013.01); *G03G 21/185* (2013.01); *G03G 2221/1869* (2013.01)

(58) Field of Classification Search
CPC ..... G03G 21/1661; G03G 21/1619; G03G 21/1807; G03G 21/185; G03G 21/1853; G03G 2221/1603; G03G 2221/1869
USPC ..... 399/110, 112, 111
See application file for complete search history.

(56) References Cited

U.S. PATENT DOCUMENTS 5,848,329 A 12/1998 Aoyama et al.
8,953,979 B2 2/2015 Mori et al.
2001/0028811 A1* 10/2001 Kojima ..... G03G 21/185 399/111
2002/0044791 A1* 4/2002 Shinkai ..... G03G 21/1619 399/112
2003/0053819 A1* 3/2003 Nomura ..... G03G 15/0896 399/110
2010/0247143 A1* 9/2010 Tateishi ..... G03G 21/1853 399/112
2011/0026968 A1* 2/2011 Ishii ..... G03G 15/0168 399/111

FOREIGN PATENT DOCUMENTS

JP 10-78737 A 3/1998
JP 2012-145877 A 8/2012

* cited by examiner

*Primary Examiner* — Sophia S Chen
(74) *Attorney, Agent, or Firm* — Fitzpatrick, Cella, Harper & Scinto

(57) ABSTRACT

An image forming apparatus, including: a plurality of image forming portions configured to form different color images; a first support member movable with respect to a main body of the image forming apparatus while supporting cartridges; and a second support member movable with respect to the main body independently of the first support member while supporting a cartridge other than the cartridges supported by the first support member, wherein the cartridges supported by the first and second support members are used in the different image forming portions, each of the first and second support members is movable between an inside position inside the main body and an outside position outside the main body, and each of the cartridges supported by the first and second support members is removably mountable in a state in which the corresponding support member is located in the outside position.

20 Claims, 20 Drawing Sheets

IMAGE FORMING APPARATUS WITH SEPARATE SUPPORT MEMBERS FOR REMOVABLE CARTRIDGES

BACKGROUND OF THE INVENTION

1. Field of the Invention

The present invention relates to an image forming apparatus using an electrophotographic image forming method.

An electrophotographic image forming apparatus uses the electrophotographic image forming method to form an image on a recording material. Examples of the electrophotographic image forming apparatus include an electrophotographic copying machine, an electrophotographic printer such as a light emitting diode (LED) printer and a laser beam printer, a facsimile machine, and a word processor.

2. Description of the Related Art

Hitherto, in an electrophotographic image forming apparatus using an electrophotographic image forming process (hereinafter referred to simply as "image forming apparatus"), there has been known a cartridge system. The cartridge system enables a cartridge to be mounted into and removed from a main body of the image forming apparatus so that components and consumable items used in the image forming apparatus are replaceable. Examples of the components to be replaced as the cartridge include an electrophotographic photosensitive drum (hereinafter referred to simply as "photosensitive drum") and a developing roller acting on the photosensitive drum. Further, the cartridge may also have a configuration in which a developer (toner) used for image formation is contained in the cartridge so that the developer is supplied to the main body through the replacement of the cartridge.

Those cartridge systems allow users themselves to perform maintenance of the image forming apparatus without service engineers. Thus, those cartridge systems have been widely used in image forming apparatus.

Further, there has also been known a configuration in which the cartridge is mountable into the main body in a state in which the cartridge is supported by a movable support member. For example, Japanese Patent Application Laid-Open No. H10-78737 discloses, in FIG. 1, a configuration in which process units respectively including image bearing members (photosensitive drums) are mounted into the main body of the image forming apparatus while being guided by a guide rail through a slide rail. In the disclosed configuration, four process units are mountable into the main body and each of the process units is mountable into and removable from the main body separately and independently. Each of the process units is moved along an axis of the corresponding image bearing member (photosensitive drum) while being supported by the slide rail and the guide rail to be mounted into the main body.

Further, there has also been known a technology of providing a support member for loading a plurality of the cartridges to the image forming apparatus and pulling out the support member from inside the main body of the image forming apparatus to a predetermined position to enable replacement work to be performed for various types of cartridges. As an example of the technology, Japanese Patent Application Laid-Open No. 2012-145877 discloses a configuration in which the main body of the image forming apparatus includes two support members. Specifically, in the configuration disclosed in Japanese Patent Application Laid-Open No. 2012-145877, the support member for supporting the plurality of photosensitive member units including the photosensitive drums and the support member for supporting the plurality of developing cartridges are provided separately. As a result, the developing cartridges can be more easily replaced. In the configuration disclosed in Japanese Patent Application Laid-Open No. 2012-145877, the plurality of photosensitive member units for respectively forming images in different colors are supported by the same support member. Further, the plurality of developing cartridges for respectively forming images in different colors are supported by the same support member.

There is the following problem in a case where the plurality of cartridges (the plurality of photosensitive member units or the plurality of developing cartridges) for respectively forming the images in different colors are supported by the same support member to be mounted into the main body as in the case of the configuration disclosed in Japanese Patent Application Laid-Open No. 2012-145877.

Specifically, even when a cartridge for forming an image in a specific color is to be replaced, a user needs to move even a cartridge for forming an image in a color different from that of the cartridge, which is required to be replaced, out of the main body. Specifically, the user needs to pull the support member for supporting the plurality of cartridges out of the main body of the image forming apparatus.

In this case, if a weight of the support member that supports the plurality of cartridges increases along with an increase in capacity of the cartridges, there is a risk in that usability (ease of use) is impaired.

Therefore, a configuration, which allows the cartridge for the specific color alone to be pulled out of the main body for replacement, is preferred. In the case of the configuration in which the plurality of process units are separately and independently mounted into the main body as disclosed in Japanese Patent Application Laid-Open No. H10-78737, however, a plurality of the slide guides for supporting the processing units are required to be prepared for each of the processing units. As a result, the configuration of the image forming apparatus becomes complex.

Therefore, a configuration that improves the usability when the user pulls the support member for supporting the cartridge out of the main body of the image forming apparatus while keeping the simple configuration of the image forming apparatus is desired.

SUMMARY OF THE INVENTION

According to a representative embodiment of the present invention, there is disclosed an image forming apparatus, comprising:

a plurality of image forming portions configured to form images of colors different from one another;

a first support member movable with respect to a main body of the image forming apparatus in a state in which the first support member supports a plurality of cartridges; and a second support member movable with respect to the main body independently of the first support member in a state in which the second support member supports a cartridge different from the plurality of cartridges supported by the first support member, wherein the plurality of cartridges supported by the first support member and the cartridge supported by the second support member are used in the plurality of image forming portions different from one another, respectively, each of the first support member and the second support member is movable between an inside position located inside of the main body and an outside position located outside of the main body, and each of the plurality of cartridges supported by the first support member and the cartridge supported by the second support member is removably mountable in a state in which the first support member and the second support member are located in the outside position.

Further features of the present invention will become apparent from the following description of exemplary embodiments with reference to the attached drawings.

DESCRIPTION OF THE EMBODIMENTS

Image forming apparatus according to embodiments of the present invention will be specifically described referring to the accompanying drawings.

First Embodiment

First, referring to FIGS. 1 to 10, a configuration of an image forming apparatus according to a first embodiment will be described.

<Image Forming Apparatus>

Figure 1:
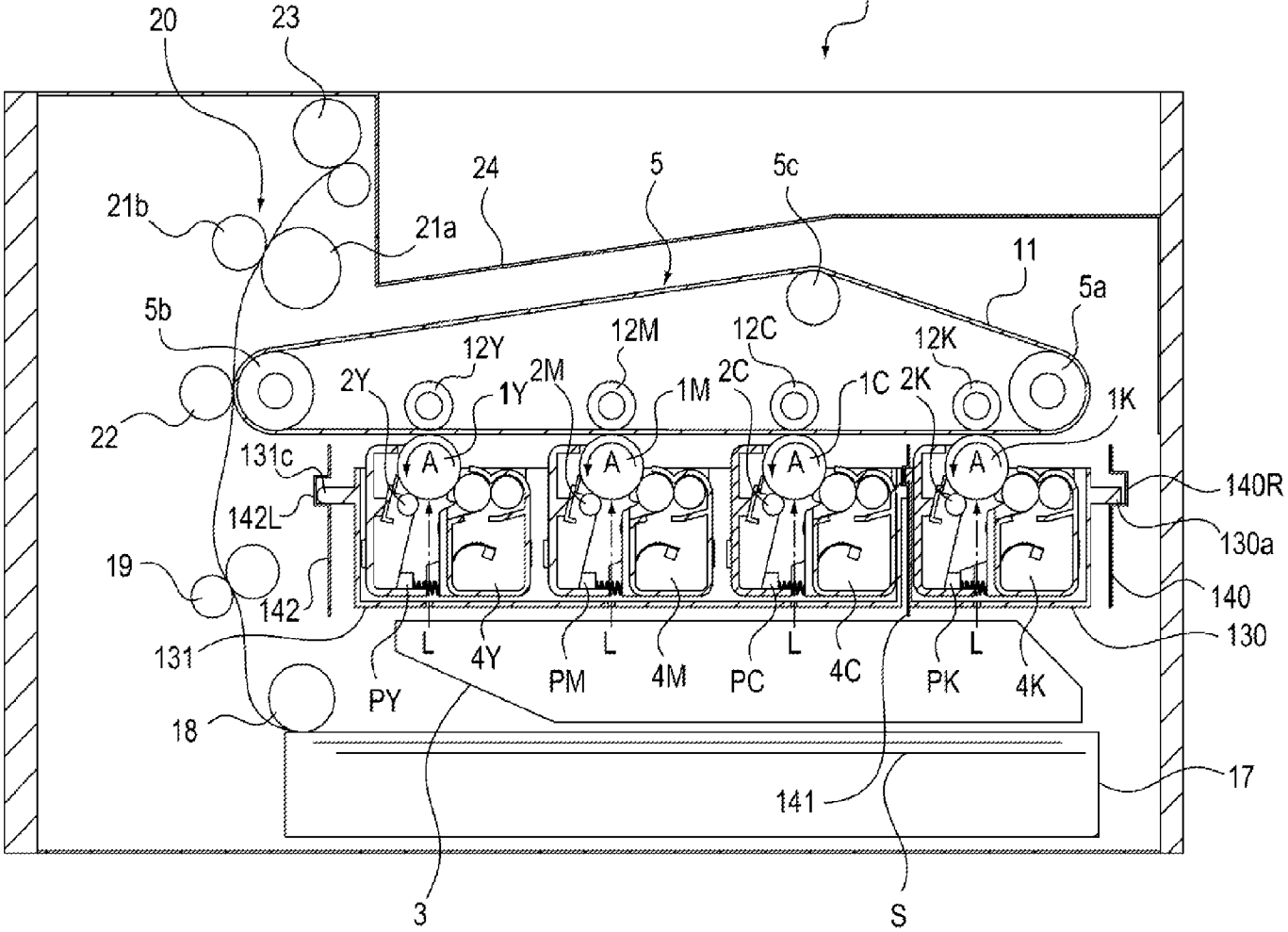
FIG. 1 is a sectional explanatory view for illustrating a configuration of an image forming apparatus according to a first embodiment.
Figure 2:
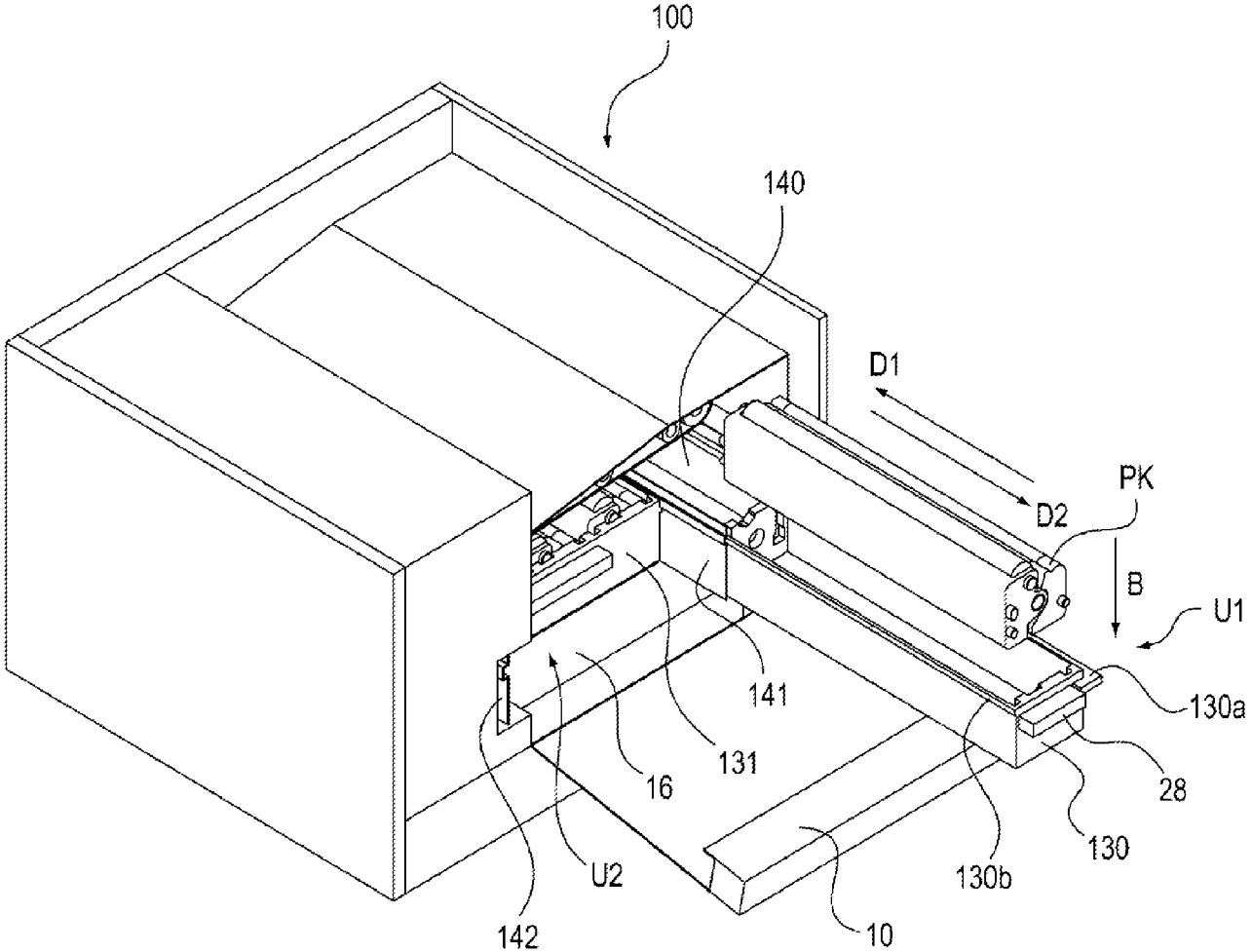
FIG. 2 is a perspective explanatory view for illustrating an operation of mounting support members into a main body of the image forming apparatus according to the first embodiment.
Figure 5:
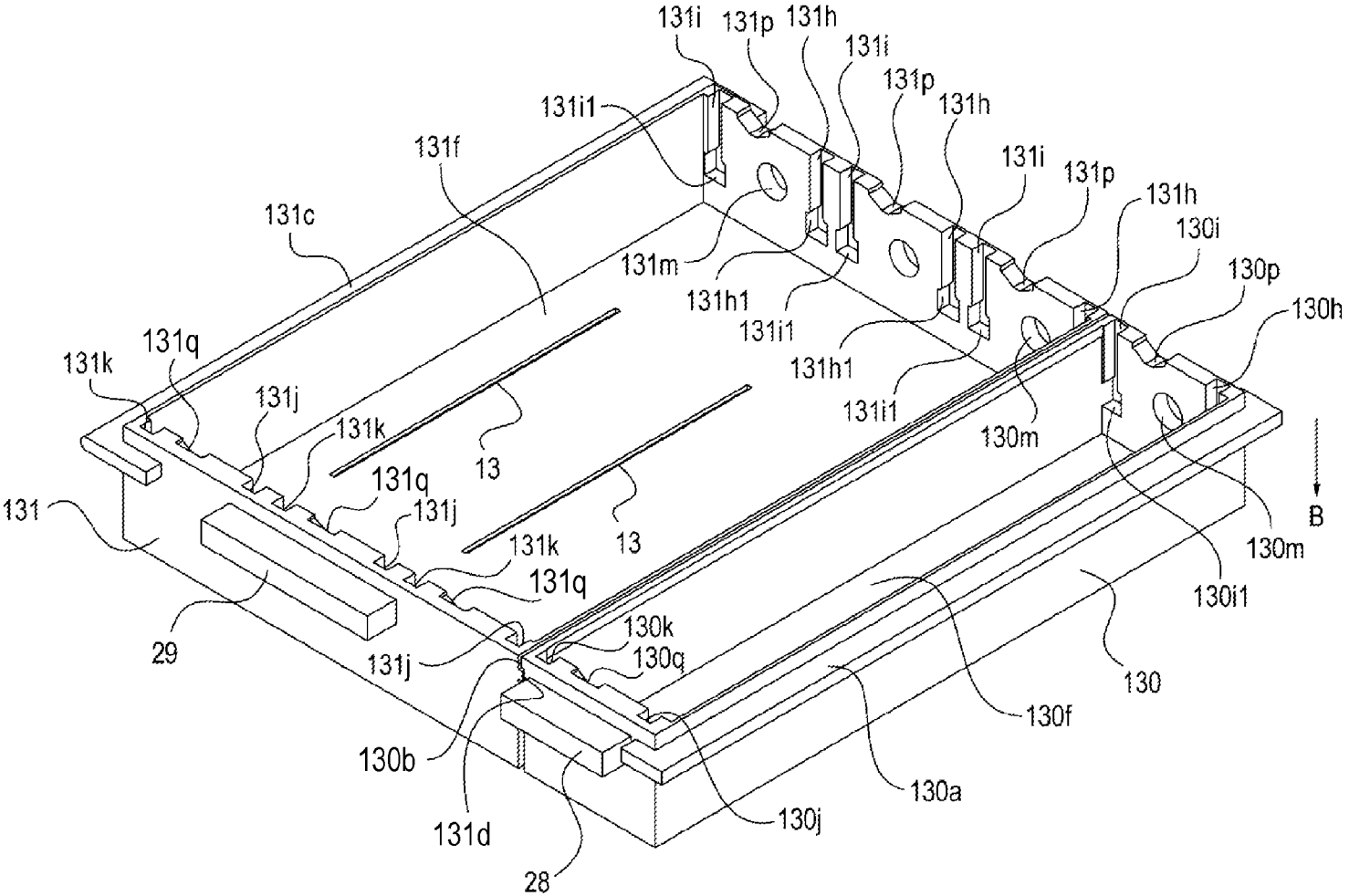
FIG. 5 is another perspective explanatory view for illustrating the configurations of the support members according to the first embodiment.
Figure 6:
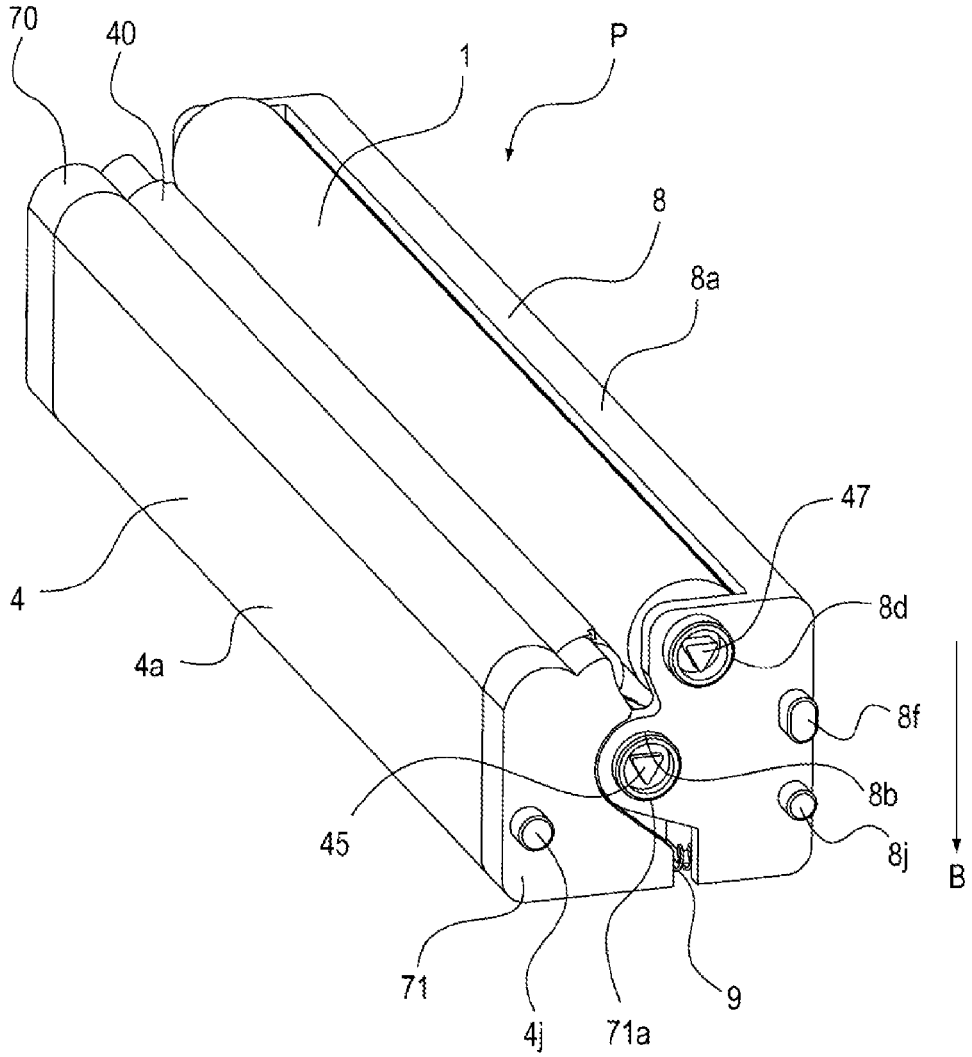
FIG. 6 is a perspective explanatory view for illustrating a cartridge according to the first embodiment as viewed from a driving side.
Figure 7:
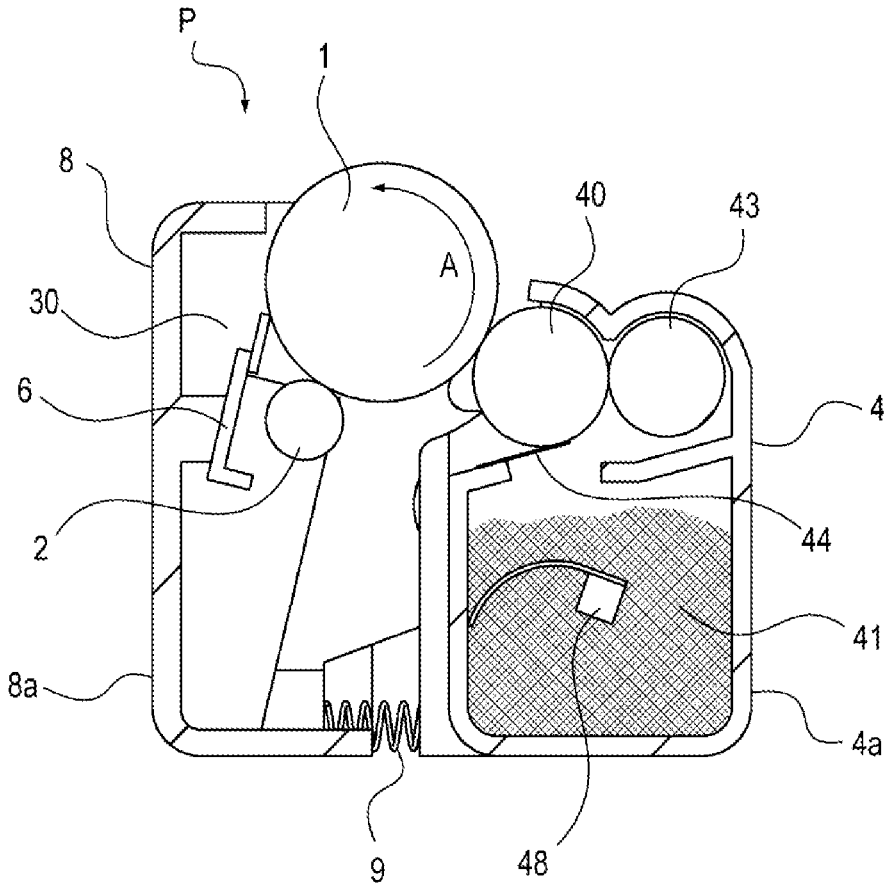
FIG. 7 is a sectional explanatory view for illustrating a configuration of the cartridge according to the first embodiment.

First, an overall configuration of a main body of an image forming apparatus 100 (main body of an image forming apparatus) according to the embodiment will be described referring to FIGS. 1 to 7. FIG. 1 is a sectional explanatory view for illustrating a configuration of the entire image forming apparatus 100 according to the embodiment. FIG. 2 is a perspective view for illustrating a state in which pullout members 130 and 131 serving as support members for supporting a plurality of cartridges P mountable into and removable from the main body of the image forming apparatus 100 according to the embodiment are pulled out. FIG. 7 is a sectional view for illustrating a configuration of the cartridge P according to the embodiment.

The image forming apparatus 100 according to the embodiment includes photosensitive drums 1. The photosensitive drums 1 are four electrophotographic photosensitive members serving as image bearing members provided side by side in a horizontal direction indicated as a crosswise direction in FIG. 1. On each of the image bearing members, an electrostatic latent image is formed. Besides the photosensitive drums 1, the image forming apparatus 100 also includes the following members as electrophotographic image forming process units. Specifically, the image forming apparatus 100 includes charging rollers 2 serving as charging units, a scanner unit 3 serving as an image exposure unit, developing units 4Y, 4M, 4C, and 4K serving as developing devices, and an intermediate transfer unit 5 serving as a transfer unit for electrostatic transfer.

The developing units 4Y, 4M, 4C, and 4K respectively contain developers for yellow Y, magenta M, cyan C, and black K. For convenience of description, the developing units 4Y, 4M, 4C, and 4K are also described simply as "developing units 4". The same applies to the other image forming process units. Each of the charging rollers 2 has a function of uniformly charging a surface of the corresponding photosensitive drum 1. The scanner unit radiates laser beams L on the surfaces of the photosensitive drums 1 based on image information to form the electrostatic latent images thereon.

The developing units 4 have a function of developing the electrostatic latent images formed on the surfaces of the photosensitive drums 1 by using toners as the developers. The intermediate transfer unit 5 has a function of transferring toner images formed on the surfaces of the photosensitive drums 1 onto a sheet S as a recording material. As specific examples of the sheet S, a paper sheet, an overhead transparency (OHT) sheet (transparent sheet used for an overhead projector (OHP)), and a cloth sheet are given. Further, the image forming apparatus 100 includes cleaning devices 6 serving as cleaning units for removing the toners remaining on the surfaces of the photosensitive drums 1 after the toner images are transferred onto the intermediate transfer belt 11.

Each of the photosensitive drums 1 includes, for example, an aluminum cylinder having an outer circumferential surface applied with an organic photoconductor layer (photosensitive member) made of an organic photoconductor (OPC). Both ends of each of the photosensitive drums 1 are rotatably supported by a support member (not shown). A first coupling member 47 illustrated in FIG. 6 is provided on one end of each of the photosensitive drums 1. The first coupling member 47 can be fitted to one of drum coupling members 25 illustrated in FIG. 3 to be engaged therewith so as to receive a rotational driving force from a driving motor (not shown). In this manner, the rotational driving force of the driving motor is transferred to the photosensitive drums 1 through the drum coupling members 25 illustrated in FIG. 3 and the first coupling members 47 illustrated in FIG. 6 so that the photosensitive drums 1 are rotated in a direction indicated by the arrow A in FIG. 1.

The charging roller 2 according to the embodiment employs a contact charging type. More specifically, the charging roller 2 is a conductive roller formed into a roller shape, and the charging roller 2 abuts against the surface of the photosensitive drum 1. Then, a charging bias voltage is applied to the charging roller 2 so that the surface of the photosensitive drum 1 is uniformly charged.

The scanner unit 3 is provided below the photosensitive drums 1, as illustrated in FIG. 1. In the scanner unit 3, the laser beams L corresponding to image signals are radiated from laser diodes (not shown) to expose the surfaces of the charged photosensitive drums 1 to light. In this manner, the electrostatic latent images in accordance with the image signals are formed on the surfaces of the photosensitive drums 1.

The developing units 4 respectively include toner containers 41 containing toners of yellow Y, magenta M, cyan C, and black K, as illustrated in FIG. 7. Each of the toner containers 41 is provided so as to be opposed to the corresponding photosensitive drum 1. Each of the toner containers 41 is a developer containing portion for containing the developer (toner) to be supplied to a corresponding developing roller 40. The developing roller is a developer carrying member for carrying the developer (toner) for developing the electrostatic latent image formed on the surface of the photosensitive drum 1.

The toners in those toner containers 41 are supplied to toner supply rollers 43. Then, the toner supply roller 43 and a developing blade 44 that is held in press-contact with an outer circumference of the developing roller 40 cause the toner to be applied to the outer circumference of the developing roller 40 and to be electrically charged.

Then, a developing bias voltage is applied to the developing roller 40 so that the toner adheres to the electrostatic latent image formed on the surface of the photosensitive drum 1. With this, the toner image is formed. Note that, the developing roller 40 is provided so as to be opposed to and brought into contact with the photosensitive drum 1. Here, the developing unit 4 and the photosensitive drum 1 are configured integrally to form a process cartridge (hereinafter referred to simply as "cartridge"). In this manner, the cartridges PY, PM, PC, and PK, which are image forming units, are formed. The cartridges P are configured by using a so-called "cartridge system" that allows each of the cartridges P to be individually replaced when the toner is used up by a user and the cartridge comes to the end of a lifetime.

The image forming apparatus 100 is a color image forming apparatus including a plurality of image forming portions for forming images in different colors. The cartridges PY, PM, PC, and PK are respectively used in the different image forming portions.

Specifically, the cartridge PY constructs a yellow image forming portion and is used to form a yellow image. Similarly, the cartridges PM, PC, and PK respectively construct a magenta image forming portion, a cyan image forming portion, and a black image forming portion.

As illustrated in FIG. 1, in the intermediate transfer unit 5 of the image forming apparatus 100, an intermediate transfer belt 11 is looped around rollers 5*a*, 5*b*, and 5*c* in a tensed manner so as to be rotatable. On an inner circumferential surface side of the intermediate transfer belt 11, primary transfer rollers 12, which are primary transfer units, are provided in positions respectively opposed to the photosensitive drums 1. By applying a primary transfer bias voltage to the primary transfer rollers 12, positive electric charges are applied to the intermediate transfer belt 11 from the primary transfer rollers 12. In this manner, the toner images formed on the surfaces of the photosensitive drums 1 are primarily transferred onto an outer circumferential surface of the intermediate transfer belt 11.

The image forming apparatus 100 further includes a feed roller 18 having a function of feeding the sheet S to the image forming portions. For the feed roller 18, a feed cassette 17 for receiving a plurality of the sheets S is provided. At the time of image formation, the feed roller 18 and registration rollers 19 rotate in accordance with an image forming operation.

In this manner, the sheets S received in the feed cassette 17 are fed one by one. Then, the sheet S is conveyed to a secondary-transfer nip portion, which is formed by the intermediate transfer belt 11 looped around the roller 5*b* and a secondary transfer roller 22 serving as a secondary transfer unit, by the registration rollers 19 so that the rotation of the intermediate transfer belt 11 and the toner image are synchronized with each other. By applying a secondary transfer bias voltage to the secondary transfer roller 22, the toner images formed on the outer circumferential surface of the intermediate transfer belt 11 are secondarily transferred onto the sheet S.

The image forming apparatus 100 includes a fixing device 20 serving as a fixing unit having a function of fixing the toner images in the plurality of colors transferred onto the sheet S. The fixing device 20 includes a heating roller 21*a* and a pressure roller 21*b*. The heating roller 21*a* rotates, whereas the pressure roller 21*b* is held in press-contact with the heating roller 21*a*. Specifically, the sheet S, onto which the toner images formed on the outer circumferential surface of the intermediate transfer belt 11 are transferred, is conveyed while being nipped between the heating roller 21*a* and the pressure roller 21*b*. Meanwhile, heat and pressure are applied to the sheet S. In this manner, the toner images in the plurality of colors are fixed onto the surface of the sheet S.

The image forming process is briefly summarized as follows. When the image forming operation is started, the photosensitive drums 1 start rotating. Then, the charging rollers 2 uniformly apply the charges to the surfaces of the photosensitive drums 1. The scanner unit 3 exposes the surfaces of the photosensitive drums 1 to light in accordance with the image signals so as to form the electrostatic latent images on the surfaces of the photosensitive drums 1. Then, by the developing rollers 40, the electrostatic latent images are developed (toners are caused to adhere). In this manner, the photosensitive drums 1 bear the developer images (toner images). The photosensitive drums 1 are image bearing members that bear the images, whereas the developing rollers 40 are developer carrying members for carrying the developers (toners) and developing the latent images.

On the other hand, the toner images in the four colors formed on the outer circumferential surface of the intermediate transfer belt 11 are transferred by the secondary transfer roller 22 onto the sheet S that is fed by the feed roller 18 and conveyed by the registration rollers 19. The sheet S, on which the toner images in the four colors are transferred, is conveyed to the fixing device 20. The sheet S, onto which the color images are fixed by the fixing device 20, is delivered to a delivery portion 24 provided outside of the image forming apparatus 100 by delivery rollers 23.

<Monochrome Mode>

The image forming apparatus 100 is a color image forming apparatus capable of forming an image in a plurality of colors, specifically, yellow, magenta, cyan, and black.

The image forming apparatus 100 is also capable of forming an image in a single color. Specifically, the image forming apparatus 100 is operable in a monochrome mode for forming an image in black and white by using only the black image forming portion (specifically, the cartridge PK). The user can select any one of the monochrome mode and a color mode for forming a color image by using all the image forming portions (specifically, the cartridges PY, PM, PC, and PK).

When the image forming apparatus 100 operates in the monochrome mode, the image is not formed by the image forming portions (specifically, the cartridges PY, PM, and PC) other than by that for black.

<Support Members>

In the embodiment, the main body of the image forming apparatus 100 (main body) means to include various members (components) constructing the image forming apparatus 100 except for at least the following members. The pullout members 130 and 131 and members (components) that are configured to be fixable to or mountable into and removable from the pullout members 130 and 131 are excluded from the main body.

Next, a configuration of each of the pullout members 130 and 131 serving as support members for supporting the cartridges P will be described referring to FIG. 2. The pullout members 130 and 131 are configured to be movable independently from each other between an inside position and an outside position. The inside position is located inside of the main body of the image forming apparatus 100, whereas the outside position is located outside of the main body of the image forming apparatus 100. FIG. 2 is a perspective view for illustrating a state in which an operation of mounting or pulling the pullout member 130 from the main body of the image forming apparatus 100 according to the embodiment.

As illustrated in FIG. 2, when a door 10, which is provided on the main body of the main forming apparatus 100 so as to be openable and closable, is opened, an opening portion 16 appears. Then, through the opening portion 16, the pullout members 130 and 131 can be pulled out.

The pullout members 130 and 131 are provided to be linearly moved substantially in a horizontal direction indicated by the arrows D1 and D2 in FIG. 2 with respect to the main body of the image forming apparatus 100 so that the mounting operation by pressing and the pullout operation can be performed. Then, the pullout members 130 and 131 can be moved between the inside positions inside the main body of the image forming apparatus 100 as illustrated in FIG. 1 and the outside positions outside the main body, respectively. FIG. 2 shows the outside position at which the pullout member 130 is pulled out of the main body of the image forming apparatus 100.

As illustrated in FIG. 2, only the pullout member 130, which is a second support member, is moved to the outside position for the main body of the image forming apparatus 100. Among the plurality of cartridges P, the pullout member 130 supports the cartridge PK (first cartridge) for forming the image in black K.

FIG. 2 is an illustration of a state in which the pullout member 131, which is a first support member, is located in the inside position for the main body of the image forming apparatus 100. The pullout member 131 supports the plurality of cartridges PY, PM, and PC for forming the images in yellow Y, magenta M, and cyan C other than black K as a first color, among the plurality of cartridges P.

As illustrated in FIG. 2, the pullout member 130 is located in the outside position for the main body of the image forming apparatus 100. In this state, the cartridge PK for black K is mounted into a mounting portion 130*f* of the pullout member 130 by the user substantially in a gravity direction indicated by the arrow B in FIG. 2.

The cartridge PK for black K mounted into the mounting portion 130*f* of the pullout member 130 as described above is arranged as follows. The cartridge PK is arranged so that a longitudinal direction (axial direction of the photosensitive drum 1) becomes parallel to the moving directions of the pullout member 130, which are indicated by the arrows D1 and D2 in FIG. 2.

For the remaining three cartridges PY, PM, and PC, the pullout member 131 is similarly located in the outside position for the main body of the image forming apparatus 100. In this state, the cartridges PY, PM, and PC can be mounted into a mounting portion 131*f* of the pullout member 131 by the user substantially in the gravity direction indicated by the arrow B in FIG. 2.

Specifically, in a state in which the pullout member 130 is located in the outside position for the main body of the image forming apparatus 100, the cartridge PK can be mounted and removed. Similarly, in a state in which the pullout member 131 is located in the outside position for the main body of the image forming apparatus 100, the cartridges PY, PM, and PC can be mounted and removed.

The four cartridges PY, PM, PC, and PK are arranged side by side in a direction perpendicular to the moving directions of the pullout members 130 and 131 indicated by the arrows D1 and D2 in FIG. 2. The pullout member 130 supports the cartridge PK, whereas the pullout member 131 supports the cartridges PY, PM, and PC. In this state, the pullout members 130 and 131 are moved between the inside position and the outside position for the main body of the image forming apparatus 100 along the directions indicated by the arrows D1 and D2 in FIG. 2, which are parallel to the longitudinal direction (axial direction) of the photosensitive drums 1.

The pullout members 130 and 131 can be pulled out from the inside position for the main body of the image forming apparatus 100 to the outside position for the main body of the image forming apparatus 100, at which the cartridges PY, PM, PC, and PK can be mounted and removed, through the opening portion 16 formed in the main body of the image forming apparatus 100.

The cartridges P are moved together with the pullout members 130 and 131 to the inside position illustrated in FIG. 1 and the outside position illustrated in FIG. 2 for the main body of the image forming apparatus 100 in a state in which the cartridges P are mounted in the pullout members 130 and 131. Then, when the door 10 is closed in a state in which the pullout members 130 and 131 are moved into the main body of the image forming apparatus 100 as illustrated in FIG. 1, all the cartridges P are positioned at predetermined positions inside the main body of the image forming apparatus 100.

As described above, according to the image forming apparatus 100 of the embodiment, the cartridge PK for black K alone can be mounted into the main body of the image forming apparatus 100. In addition, the cartridge PK for black K alone can be pulled out of the main body of the image forming apparatus 100. Therefore, the four cartridges P are not required to be pulled out together. Thus, only the cartridge PK for black K, which is highly frequently used for both in the monochrome mode and the color mode, can be replaced. Therefore, in contrast to the configuration in which the four cartridges P are inevitably pulled out together, there is provided excellent workability in replacement in a case where the capacity of each of the cartridges P is increased.

Even in an image forming apparatus for which the user cannot make a selection between the monochrome mode and the color mode, the image in black K is generally frequently formed. Therefore, the configuration, in which only the cartridge PK for black K is supported by the pullout member 130 so as to be mounted into the main body of the image forming apparatus 100, is effective.

Further, the pullout member 131 supports the plurality of cartridges P. Specifically, the plurality of cartridges PY, PM, and PC, which are relatively less frequently used, are all supported by the pullout member 131. Therefore, the number of pullout members can be kept down to two in total. Accordingly, the configuration of the image forming apparatus 100 can be prevented from becoming complex and increasing in size due to an increased number of pullout members.

<Mounting Portion for Support Members>

Figure 3:
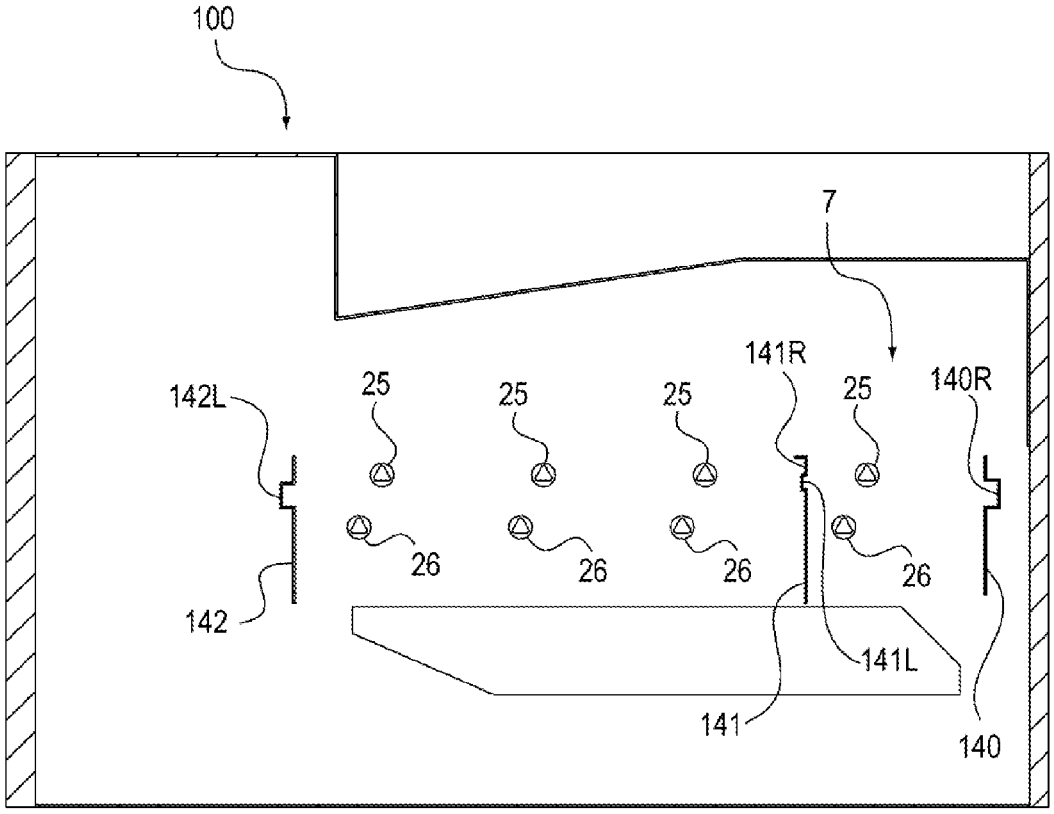
FIG. 3 is a sectional explanatory view for illustrating a configuration of a mounting portion of the main body of the image forming apparatus for the support members according to the first embodiment.
Figure 4:
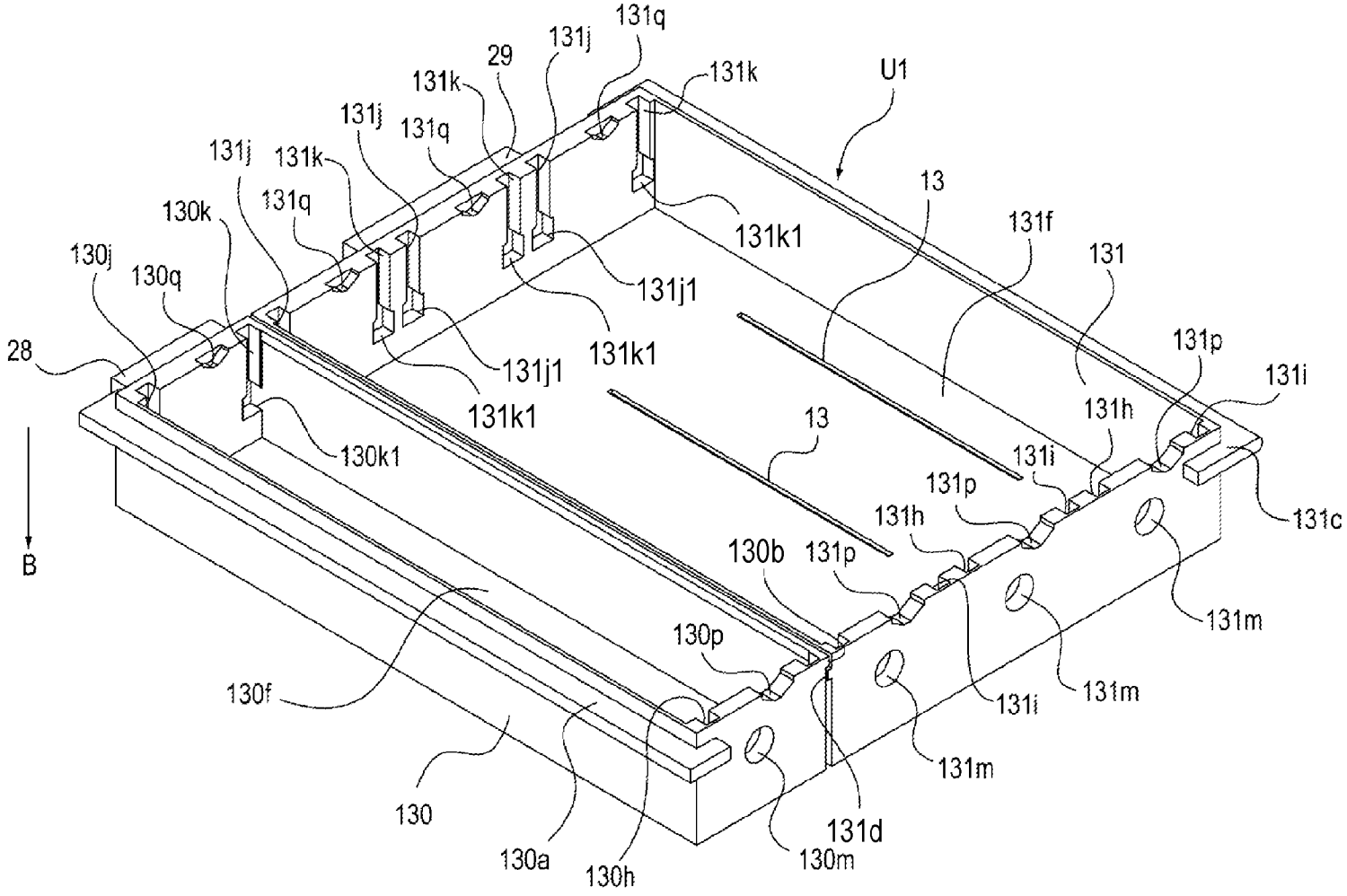
FIG. 4 is a perspective explanatory view for illustrating configurations of the support members according to the first embodiment.

Next, a configuration of a mounting portion 7 of the main body of the image forming apparatus 100 for the pullout members 130 and 131 will be described referring to FIGS. 3 to 5. FIG. 3 is a sectional view for illustrating the configuration of the mounting portion 7 of the main body of the image forming apparatus 100 for the pullout members 130 and 131 according to the embodiment. FIGS. 4 and 5 are perspective views for illustrating a configuration of engagement portions of the pullout members 130 and 131, which are to be engaged with the mounting portion 7 of the main body of the image forming apparatus 100 according to the embodiment. In FIG. 3, the intermediate transfer unit 5 is omitted from the members (components) constructing the image forming apparatus 100 for easy understanding of the configuration of the mounting portion 7.

As illustrated in FIG. 3, guiding members 140 to 142 for guiding the directions of movement of the pullout members 130 and 131 are provided inside of the main body of the image forming apparatus 100. In the guiding members 140 to 142, a pair of guiding portions 140R and 141L and a pair of guiding portions 141R and 142L are formed so that the guiding portions 140R and 141L are opposed to each other and the guiding portions 141R and 142L are opposed to each other.

Each of the guiding portions 140R, 141L, 141R, and 142L has a groove portion with a U-like cross section. Guided portions 130*a* and 130*b* of the pullout member 130 and guided portions 131*d* and 131*c* of the pullout member 131 illustrated in FIGS. 4 and 5 are slidably fitted into the guiding portions 140R and 141L and the guiding portions 141R and 142L, respectively. In this manner, the pullout members 130 and 131 are movably guided in the directions indicated by the arrows D1 and D2 illustrated in FIG. 2 along the guiding portions 140R and 141L and the guiding portions 141R and 142L, respectively.

The guiding portions 140R, 141L, 141R, and 142L can guide the pullout members 130 and 131 from a position, at which the pullout members 130 and 131 are pulled out of the main body of the image forming apparatus 100, to a position at which the pullout members 130 and 131 are accommodated into the main body of the image forming apparatus 100. The guiding portions 140R, 141L, 141R, and 142L are provided so as to extend substantially in a horizontal direction from the vicinity of an inlet of the opening portion 16, at which the door 10 for the main body of the image forming apparatus 100 is provided, to a far side of the main body of the image forming apparatus 100.

As illustrated in FIG. 3, inside the main body of the image forming apparatus 100, the drum coupling members 25 for transferring the drive to the photosensitive drums 1 are provided. Further, development coupling members 26 for transferring the drive to the developing rollers 40 are also provided. The drum coupling members 25 are provided at equal intervals in the horizontal direction, whereas the development coupling members 26 are provided at equal intervals in the horizontal direction.

The drum coupling members 25 and the development coupling members 26 transfer the rotational driving force from the motor serving as a driving source (not shown) to the photosensitive drums 1 and the developing rollers 40 provided rotatably in the cartridges P. In a state in which the door 10, which is provided on the main body of the image forming apparatus 100 so as to be openable and closable, is opened, the drum coupling members 25 and the development coupling members 26 retract inside side walls of the main body of the image forming apparatus 100.

Then, in conjunction with the operation of closing the door 10, the drum coupling members 25 and the development coupling members 26 project from one of the side walls of the main body of the image forming apparatus 100. Then, the drum coupling members 25 and the development coupling members 26 move toward the first coupling members 47 and the second coupling members 45 of FIG. 6 provided on the longitudinal ends of the cartridges P so as to come into engagement therewith. As a result, the rotational driving force can be transferred.

<Support Members>

Next, the configurations of the pullout members 130 and 131, which are the support members, are described referring to FIGS. 4 and 5. FIG. 4 is a perspective view of the pullout members 130 and 131 in the main body of the image forming apparatus 100 according to the embodiment. FIG. 5 is a perspective view of the pullout members 130 and 131 as viewed from a side opposite to that in FIG. 4.

As illustrated in FIGS. 4 and 5, the guided portions 130*a* and 130*b* to be guided by the guiding portions 140R and 140L of the main body of the image forming apparatus 100 illustrated in FIG. 3 are formed on both ends of the pullout member 130 in a direction of arrangement of the cartridges. The guided portions 130*a* and 130*b* are extended in the longitudinal direction of the pullout member 130. The guided portions 131*d* and 131*c* to be guided by the guiding portions 141R and 142L of the main body of the image forming apparatus 100 illustrated in FIG. 3 are formed on both ends of the pullout member 131 in the direction of arrangement of the cartridges. The guided portions 131*d* and 131*c* are extended in the longitudinal direction of the process cartridge P mounted in the pullout member 131.

The guided portion 130*a* is slidably fitted to the guiding portion 140R to be guided, whereas the guided portion 130*b* is slidably fitted to the guiding portion 141L to be guided. Further, the guided portion 131*d* is slidably fitted to the guiding portion 141R to be guided, whereas the guided portion 131*c* is slidably fitted to the guiding portion 142L to be guided.

A grip portion 28 for allowing the user to operate the pullout member 130 is provided on one end of the pullout member 130, as illustrated in FIG. 5. A grip portion 29 is provided on one end of the pullout member 131.

Further, the mounting portion 130*f* for mounting the cartridge PK for black K is formed in the pullout member 130, whereas the mounting portion 131*f* for mounting the cartridges P for the other colors is formed in the pullout member 131.

Further, as illustrated in FIGS. 4 and 5, slits 13, each being an elongated through hole, are formed through bottom portions of the mounting portion 130*f* of the pullout member 130 and the mounting portion 131*f* of the pullout member 131 so as to correspond to the positions of the respective photosensitive drums 1. The slits 13 are openings through which the laser beams L emitted from the scanner unit 3 illustrated in FIG. 1 pass.

Guiding portions 130*h* to 130*k* are respectively formed on inner wall surfaces on both longitudinal ends of the mounting portion 130*f* formed in the pullout member 130, as illustrated in FIGS. 4 and 5. Each of the guiding portions 130*h* to 130*k* is a groove portion that is open upward, for mounting the cartridge PK for black K into the mounting portion 130*f* of the pullout member 130.

Each of the guiding portions 130*h* to 130*k* extends in a vertical direction indicated by the arrow B in FIGS. 4 and 5. A positioning portion 130*p* is formed on an upper portion of the inner wall on one longitudinal end of the mounting portion 130*f* so as to be located between the guiding portions 130*h* and 130*i*, whereas a positioning portion 130*q* is formed on an upper portion of the inner wall on another longitudinal end of the mounting portion 130*f* so as to be located between the guiding portions 130*j* and 130*k*. The positioning portions 130*p* and 130*q* position the cartridge PK for black K with respect to the pullout member 130. Each of the positioning portions 130*p* and 130*q* is formed to have a V-shaped cross section.

Similarly, guiding portions 131*h* to 131*k* are formed on inner wall surfaces of both longitudinal ends of the mounting portion 131*f* formed in the pullout member 131, as illustrated in FIGS. 4 and 5. Each of the guiding portions 131*h* to 131*k* is a groove portion that is open upward, for mounting the cartridges P for the other colors into the mounting portion 131*f* of the pullout member 131.

Each of the guiding portions 131*h* to 131*k* extends in the vertical direction indicated by the arrow B in FIGS. 4 and 5. A positioning portion 131*p* is formed on an upper portion of the inner wall of one longitudinal end of the mounting portion 131*f* so as to be located between the guiding portions 131*h* and 131*i*, whereas a positioning portion 131*q* is formed on an upper portion of the inner wall of another longitudinal end of the mounting portion 131*f* so as to be located between the guiding portions 131*j* and 131*k*. The positioning portions 131*p* and 131*q* position the cartridges PY, PM, and PC for the other colors with respect to the pullout member 131. Each of the positioning portions 131*p* and 131*q* is formed to have a V-shaped cross section.

As illustrated in FIG. 4, the pullout member 130 has an opening portion 130*m*. The opening portion 130*m* is a through hole into which the development coupling member 26 illustrated in FIG. 3 moves. The development coupling member 26 illustrated in FIG. 3 moves into the opening portion 130*m*, which is the through hole, in conjunction with the operation of closing the door 10 illustrated in FIG. 2. Then, the development coupling member 26 is fitted and coupled to the second coupling member 45K which is provided on a rotary shaft of an intermediate gear (not shown) meshing with a driving gear provided on an end of a rotary shaft of the developing roller 40K of the cartridge PK illustrated in FIG. 6.

Further, the pullout member 131 has opening portions 131*m*. The opening portions 131*m* are through holes into which the development coupling members 26 illustrated in FIG. 3 move. The development coupling members 26 illustrated in FIG. 3 move into the opening portions 131*m*, which are the through holes, in conjunction with the operation of closing the door 10 illustrated in FIG. 2. Then, the development coupling members 26 are fitted and coupled to the second coupling members 45 which are provided on rotary shafts of intermediate gears (not shown) meshing with driving gears provided on ends of rotary shafts of the developing rollers 40 of the other cartridges P illustrated in FIG. 6.

<Cartridges>

Figure 8:
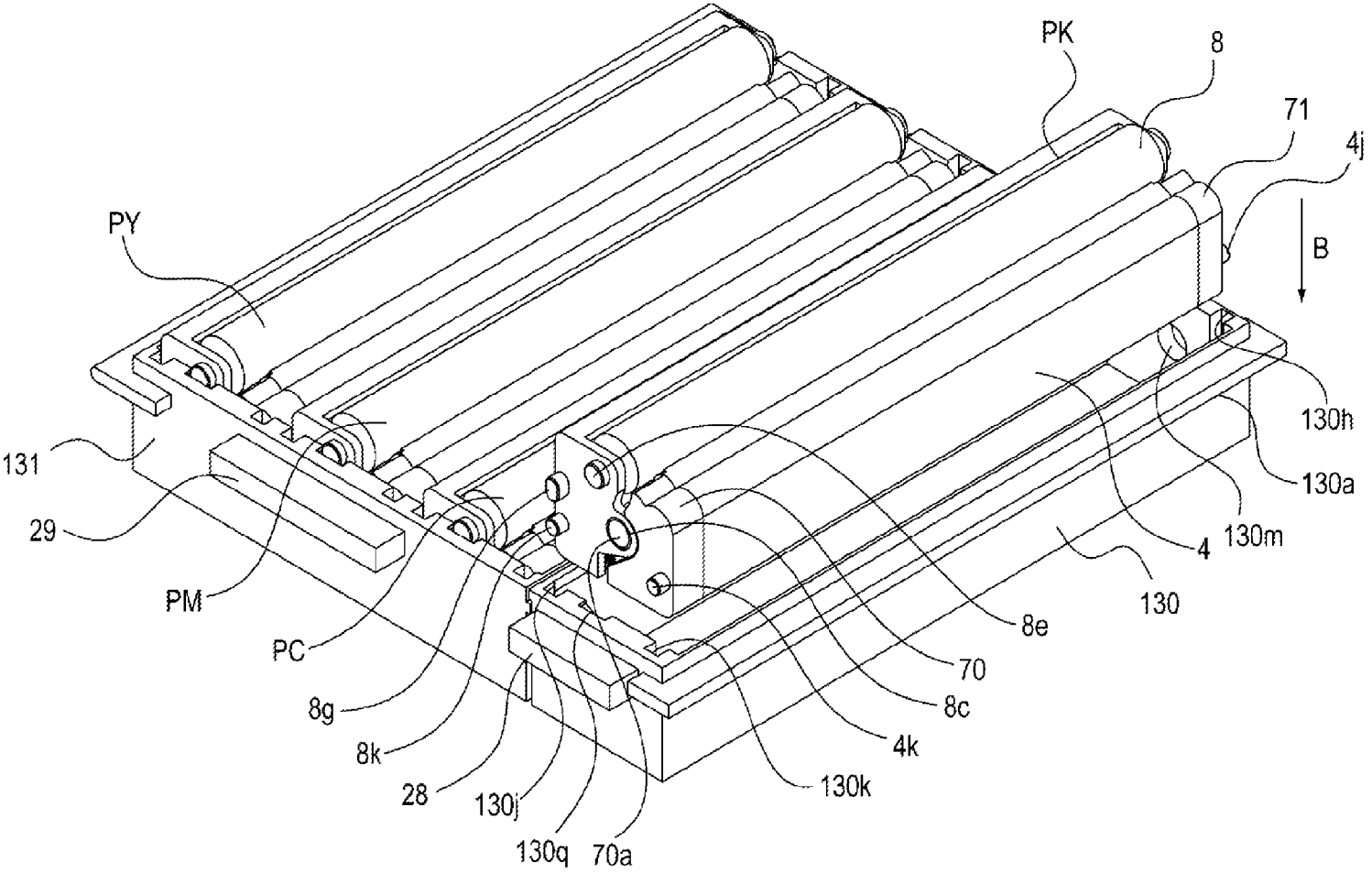
FIG. 8 is a perspective explanatory view for illustrating a state in which one of the cartridges according to the first embodiment is being mounted into the support member.

Next, a configuration of each of the cartridges P to be mounted in the pullout members 130 and 131 will be described referring to FIGS. 6 to 8. FIG. 6 is a perspective view for illustrating the configuration of the cartridge P according to the embodiment. FIG. 7 is a sectional view for illustrating the configuration of the cartridge P according to the embodiment. FIG. 8 is a perspective view for illustrating a state in which the cartridge PK for black K according to the embodiment is being mounted into the pullout member 130.

As illustrated in FIGS. 6 and 7, the cartridge P includes a photosensitive member unit 8 and the developing unit 4. The photosensitive member unit 8 includes the photosensitive drum 1, a frame 8*a* for supporting the photosensitive drum 1, the charging roller 2, the cleaning device 6, and a waste toner container 30 for containing the toner removed by the cleaning device 6.

Further, the developing unit 4 includes the developing roller 40, a frame 4*a* for supporting the developing roller 40, and the toner supply roller 43. The developing unit 4 further includes the developing blade 44, the toner container 41 for containing the toner to be used for image formation, and a conveying member 48 for supplying the toner in the toner container 41.

As illustrated in FIG. 7, the toner in the toner container 41 is supplied to the toner supply roller 43 by the conveying member 48. Then, the toner supply roller 43 and the developing blade 44 that is held in press-contact with the surface of the developing roller 40 cause the toner to be applied to the surface of the developing roller 40 and to be electrically charged.

Then, a developing bias voltage is applied from the main body of the image forming apparatus 100 to the developing roller 40. As a result, the toner adheres to the electrostatic latent image formed on the surface of the photosensitive drum 1 to form the toner image. After the toner image developed on the surface of the photosensitive drum 1 is transferred onto the outer circumferential surface of the intermediate transfer belt 11, the toner remaining on the surface of the photosensitive drum 1 is removed by the cleaning device 6 so as to be contained in the waste toner container 30.

When the toner in the toner container 41 is used up, the user can perform printing again after replacing the cartridge P. As illustrated in FIG. 6, the first coupling member 47 provided on one end of the rotary shaft of the photosensitive drum 1 is rotatably supported by one longitudinal end of the cartridge P. The first coupling member 47 is coupled to the drum coupling member 25 provided on the main body of the image forming apparatus 100, which is illustrated in FIG. 3, so as to receive the rotational driving force.

Further, the second coupling member 45, which is provided on the rotary shaft of the intermediate gear (not shown) meshing with the driving gear provided on one end of the rotary shaft of the developing roller 40, is rotatably supported by the one longitudinal end of the cartridge P. The second coupling member 45 is coupled to the development coupling member 26 provided on the main body of the image forming apparatus 100, which is illustrated in FIG. 3, so as to receive the rotational driving force.

The photosensitive drum 1 is rotated by the rotational driving force that is received by the first coupling member 47 illustrated in FIG. 6 from the main body of the image forming apparatus 100 through the drum coupling member 25 illustrated in FIG. 3. Further, the rotational driving force, which is received by the second coupling member 45 illustrated in FIG. 6 from the main body of the image forming apparatus 100 through the development coupling member 26 illustrated in FIG. 3, is transferred as follows. The rotational driving force is transferred through the intermediate gear (not shown) to the developing roller 40, the toner supply roller 43, and the conveying member 48 so that the developing roller 40, the toner supply roller 43, and the conveying member 48 rotate simultaneously.

As illustrated in FIG. 6, an engagement portion 71*a*, which is a cylindrical rib and covers the second coupling member 45, is formed on an outer circumference of the second coupling member 45. The engagement portion 71*a* is formed on a side cover 71 that is fixed to one longitudinal end of the toner container 41.

The second coupling member 45 is configured to be rotatable with respect to the engagement portion 71*a*. Further, as illustrated in FIG. 8, an engagement portion 70*a* is formed on the side opposite to the engagement portion 71*a*. Similarly to the engagement portion 71*a*, the engagement portion 70*a* is formed on a side cover 70 that is fixed to another longitudinal end of the toner container 41. The engagement portions 71*a* and 70*a* are both formed on the developing unit 4.

Further, hole portions 8*b* and 8*c* are formed in the frame 8*a* of the photosensitive member unit 8. The hole portions 8*b* and 8*c* are through holes through which the engagement portions 71*a* and 70*a* formed on the developing unit 4 are inserted so as to turnably support the engagement portions 71*a* and 70*a*.

The hole portions 8*b* and 8*c* formed in the frame 8*a* of the photosensitive member unit 8 respectively come into engagement with the engagement portions 71*a* and 70*a* formed on the development unit 4. In this manner, the photosensitive member unit 8 and the developing unit 4 are coupled to each other so as to be turnable about the engagement portions 71*a* and 70*a* as a center.

The engagement portions 71*a* and 70*a* formed on the developing unit 4 are configured to turn with respect to the hole portions 8*b* and 8*c* formed in the frame 8*a* of the photosensitive member unit 8 so as to be movable. Therefore, the developing unit 4 can turn about the engagement portions 71*a* and 70*a* as a center with respect to the photosensitive member unit 8 to move. Specifically, the developing roller 40 is configured to be movable with respect to the photosensitive drum 1.

A spring 9 is provided as a biasing member between the photosensitive member unit 8 and the developing unit 4, as illustrated in FIGS. 6 and 7. The spring 9 is provided on a side opposite to the developing roller 40 and the photosensitive drum 1 across the engagement portions 71*a* and 70*a*. The developing roller 40 is pressed by the spring 9 against the photosensitive drum 1 with a predetermined pressure.

As illustrated in FIG. 6, a positioned portion 8*d*, which is a cylindrical rib and covers the first coupling member 47, is formed on an outer circumference of the first coupling member 47. Further, as illustrated in FIG. 8, a positioned portion 8*e*, which is formed as a cylindrical projection, is formed on the photosensitive member unit 8 on the side opposite to the side where the positioned portion 8*d* is formed, in the longitudinal direction.

Further, as illustrated in FIG. 6, a rotation regulated portion 8*f* having an oval cross section is formed below the positioned portion 8*d* illustrated in FIG. 6. As illustrated in FIG. 8, a rotation regulated portion 8*g* having an oval cross section is formed below the positioned portion 8*e* illustrated in FIG. 8.

Each of the rotation regulated portions 8*f* and 8*g* has a columnar shape with an oval cross section, which extends in the same direction as a direction in which the cartridges P are mounted into the pullout members 130 and 131.

The positioned portions 8*d* and 8*e* and the rotation regulated portions 8*f* and 8*g* formed on the longitudinal ends of the photosensitive member unit 8 have a function of positioning the cartridge P inside the pullout member 130 or 131.

Further, regulated portions 8*j* and 8*k*, each having a columnar shape, are respectively formed below the rotation regulated portions 8*f* and 8*g* formed on the longitudinal ends of the photosensitive member unit 8 in FIGS. 6 and 8. Regulated portions 4*j* and 4*k*, each having a columnar shape, are formed on the longitudinal ends of the developing unit 4 so as to correspond to height positions of the regulated portions 8*j* and 8*k*.

The regulated portions 8*j* and 8*k* are formed on the photosensitive member unit 8 at such positions that the photosensitive drum 1 is interposed therebetween, whereas the regulated portions 4*j* and 4*k* are formed on the developing unit 4 at such positions that the photosensitive drum 1 is interposed therebetween. The regulated portions 8*j*, 4*j*, 8*k*, and 4*k* are formed at substantially the same position in the direction indicated by the arrow B in FIG. 8, in which the cartridges P are mounted into the pullout members 130 and 131.

<Operation of mounting Cartridges to Support Members>

Figure 9:
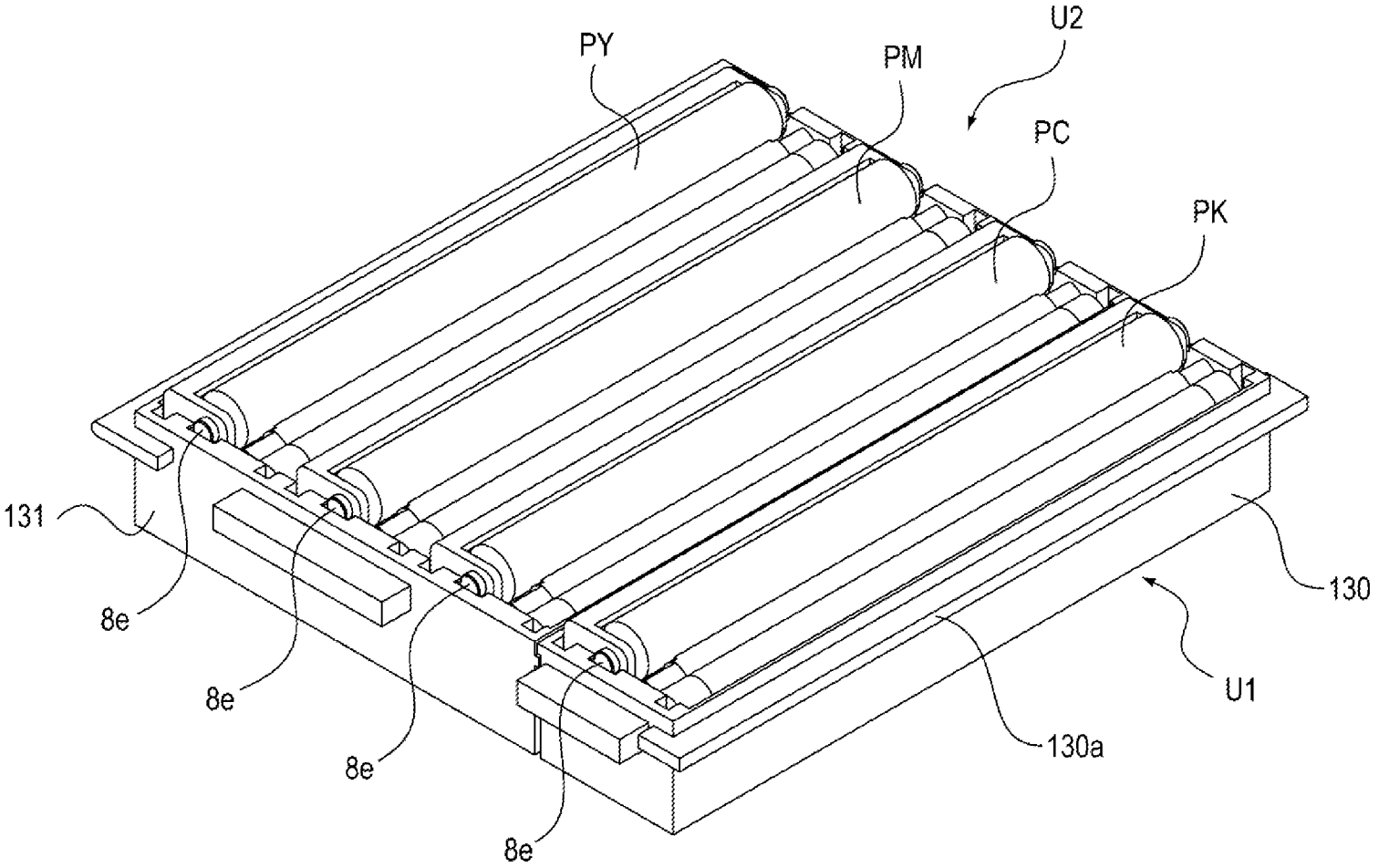
FIG. 9 is a perspective explanatory view for illustrating a state in which the cartridges are mounted into the support members according to the first embodiment.

Next, an operation of mounting the cartridges P into the mounting portion 130*f* of the pullout member 130 and the mounting portion 131*f* of the pullout member 131 will be described referring to FIGS. 8 and 9. For convenience of the description, mounting of the cartridge PK for black K into the pullout member 130 is representatively described. FIG. 8 is a perspective view for illustrating a state in which the cartridge PK for black K is mounted into the mounting portion 130*f* of the pullout member 130. FIG. 9 is a perspective view for illustrating a state in which all the cartridges P are mounted in the mounting portion 130*f* of the pullout member 130 and the mounting portion 131*f* of the pullout member 131.

As illustrated in FIG. 8, the cartridge PK for black K is mounted into the mounting portion 130*f* formed in the pullout member 130. The user mounts the cartridge PK for black K into the mounting portion 130*f* formed in the pullout member 130 in the direction indicated by the arrow B in FIG. 8, which is substantially the gravity direction.

The cartridge PK for black K is mounted into the mounting portion 130*f* formed in the pullout member 130. In this case, the user first mounts the regulated portions 8*j*, 4*j*, 8*k*, and 4*k* illustrated in FIGS. 6 and 8, which are formed on the both longitudinal ends of the cartridge PK for black K in the following manner.

Specifically, the regulated portions 8*j*, 4*j*, 8*k*, and 4*k* are inserted along the guiding portions 130*h* to 130*k* formed on the inner wall surfaces of the mounting portion 130*f* of the pullout member 130 illustrated in FIGS. 4 and 5 in the direction indicated by the arrow B in FIG. 8, which is the gravidity direction, so as to be mounted into the mounting portion 130*f*. In this state, the cartridge PK for black K is mounted into the mounting portion 130*f* formed in the pullout member 130 with a predetermined clearance therebetween.

Further, the user inserts the rotation regulated portions 8*f* and 8*g*, which are formed on the both longitudinal ends of the photosensitive member unit 8, along the guiding portions 130*i* and 130*k* formed on the inner wall surfaces of the mounting portion 130*f* of the pullout member 130 in the direction indicated by the arrow B in FIG. 8, which is the gravity direction.

In this manner, the cartridge PK for black K is guided by the guiding portions 130*h* to 130*k* formed on the inner wall surfaces of the mounting portion 130*f* of the pullout member 130 illustrated in FIGS. 4 and 5 to be mounted into the mounting portion 130*f* of the pullout member 130.

The cartridge PK for black K is mounted into the mounting portion 130*f* of the pullout member 130. Then, the positioned portions 8*d* and 8*e*, each having a columnar shape, formed on the both longitudinal ends of the cartridge PK illustrated in FIGS. 6 and 8 come into abutment against the positioning portions 130*p* and 130*q*, each having a V-shaped cross section, formed on the upper portions of the wall surfaces of the mounting portion 130*f* of the pullout member 130. In this manner, the cartridge PK for black K can be positioned in the mounting direction indicated by the arrow B in FIG. 8.

Further, the rotation regulated portions 8*f* and 8*g* formed on the both longitudinal ends of the photosensitive member unit 8 are as follows. The rotation regulated portions 8*f* and 8*g* respectively come into abutment against side surfaces of the guiding portions 130*i* and 130*k* formed on the inner wall surfaces of the mounting portion 130*f* of the pullout member 130 illustrated in FIGS. 4 and 5 to allow the cartridge PK for black K to be positioned in a rotating direction.

Then, by the positioned portions 8*d* and 8*e* and the rotation regulated portions 8*f* and 8*g* formed on the both longitudinal ends of the photosensitive member unit 8, the cartridge PK for black K can be positioned inside the positioning portion 130*f* of the pullout member 130.

The regulated portions 8*j*, 4*j*, 8*k*, and 4*k* formed on the both longitudinal ends of the cartridge PK for black K illustrated in FIGS. 6 and 8 retract as follows. The regulated portions 8*j*, 4*j*, 8*k*, and 4*k* retract into retraction portions 130*h*1 to 130*k*1 (only retraction portions 130*i*1 and 130*k*1 are illustrated in FIGS. 4 and 5). The retraction portions 130*h*1 to 130*k*1 are formed in communication respectively with lower ends of vertical groove portions as the guiding portions 130*h* to 130*k* formed on the inner wall surfaces of the mounting portion 130*f* of the pullout member 130 illustrated in FIGS. 4 and 5 so as to expand in the horizontal direction.

In a state in which the regulated portions 8*j*, 4*j*, 8*k*, and 4*k* retract into the retraction portions 130*h*1 to 130*k*1, the regulated portions 8*j*, 4*j*, 8*k*, and 4*k* do not interfere with and disturb the positioning of the cartridge PK for black K with respect to the mounting portion 130*f* of the pullout member 130.

Similarly, the cartridges PY, PM, and PC are also mounted into the mounting portion 131*f* of the pullout member 131. The regulated portions 8*j*, 4*j*, 8*k*, and 4*k* formed on both longitudinal ends of the cartridges P for the other colors illustrated in FIGS. 6 and 8 retract as follows. The regulated portions 8*j*, 4*j*, 8*k*, and 4*k* retract into the retraction portions. The retraction portions are formed in communication respectively with the lower ends of the vertical groove portions as the guiding portions 131*h* to 131*k* formed on the inner wall surfaces of the mounting portion 131*f* of the pullout member 131 illustrated in FIGS. 4 and 5 so as to expand in the horizontal direction.

<Operation of Mounting Support Members into Main Body of Image Forming Apparatus>

Next, an operation of mounting pullout units U1 and U2, in which the cartridges P for the respective colors are mounted into the mounting portion 130*f* of the pullout member 130 and the mounting portion 131*f* of the pullout member 131, into the main body of the image forming apparatus 100 will be described referring to FIGS. 9 and 10.

For convenience of the description, an operation of mounting the pullout unit U1 into the main body of the image forming apparatus 100 is representatively described. As illustrated in FIG. 9, the pullout member 130 in a state in which the cartridge PK for black K is mounted in the mounting portion 130*f* is referred to as "pullout unit U1". The pullout member 131 in a state in which the cartridges PY, PM, and PC for the other colors are mounted in the mounting portion 131*f*, is referred to as "pullout unit U2".

Figure 10:
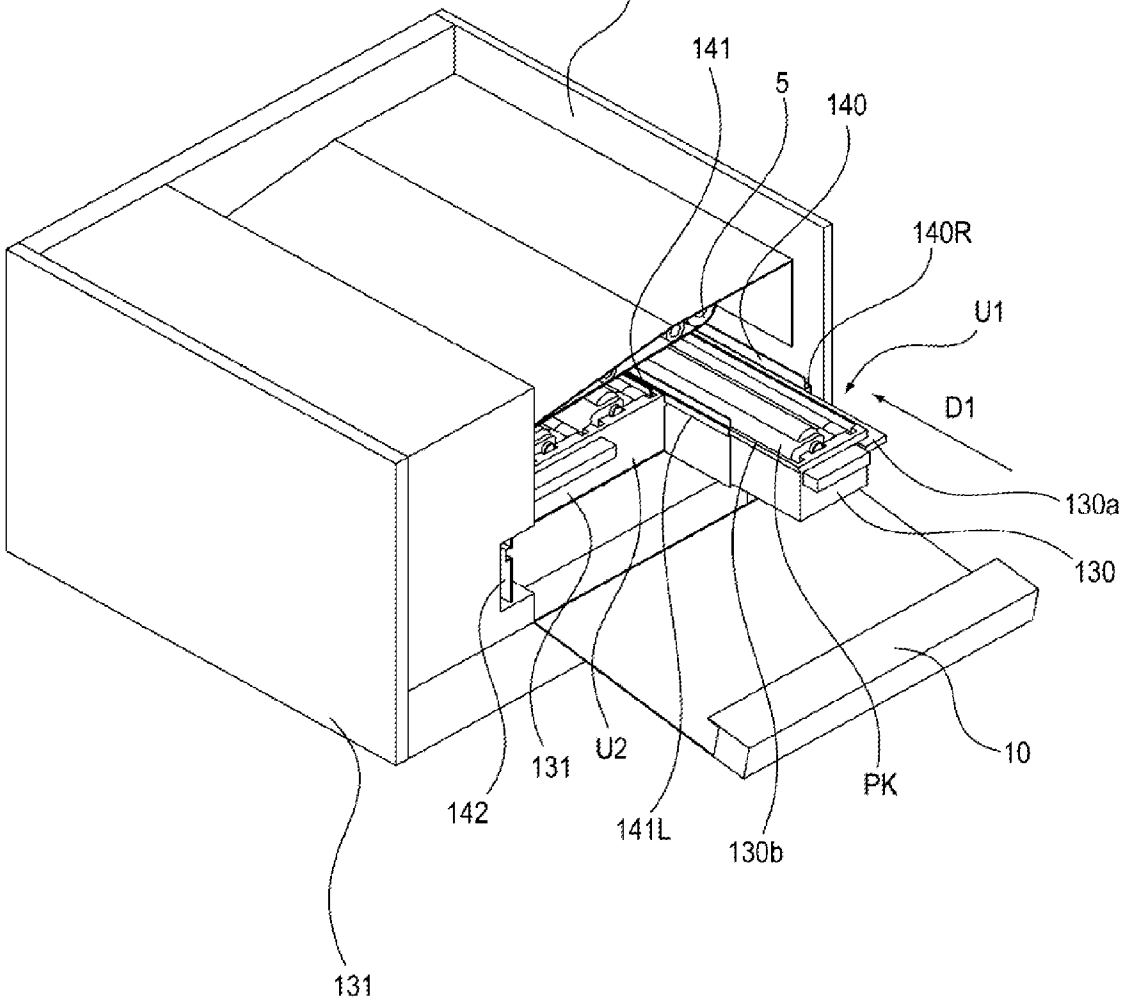
FIG. 10 is a perspective explanatory view for illustrating a state in which one of the support members according to the first embodiment is being mounted into the main body of the image forming apparatus.

FIG. 10 is a perspective view for illustrating a state in which the pullout unit U1 according to the embodiment is being mounted into the main body of the image forming apparatus 100. As illustrated in FIG. 10, the guided portions 130*a* and 130*b* of the pullout unit U1, which are flange portions formed along the longitudinal direction of the pullout member 130, are mounted in the following manner. The guided portions 130*a* and 130*b* are respectively fitted into the guiding portions 140R and 141R formed on the main body of the image forming apparatus 100 illustrated in FIG. 3 and are mounted along the guiding portions 140R and 141R in the direction indicated by the arrow D1 in FIG. 10.

As illustrated in FIG. 10, the intermediate transfer unit 5 is moved by a moving unit (not shown) in conjunction with the operation of opening the door 10 supported turnably by the main body of the image forming apparatus 100 so as to retract from an image forming position.

Therefore, during the operation of mounting and pulling out the pullout unit U1, the surface of the photosensitive drum 1 and the outer circumferential surface of the intermediate transfer belt 11 of the intermediate transfer unit 5 do not slide against each other. The pullout unit U2 can be mounted into the main body of the image forming apparatus 100 in the same manner.

FIG. 1 is an illustration of a state in which the door 10 illustrated in FIG. 10 is closed. Along with the user's operation of closing the door 10, the drum coupling members 25 and the development coupling members 26 illustrated in FIG. 3 project from the side wall of the main body of the image forming apparatus 100. The development coupling members 26 move into the opening portions 130*m* and 131*m* in the following manner.

Specifically, the development coupling members 26 move into the opening portion 130*m* that is formed through one-side wall surface of the pullout member 130 and the opening portions 131*m* that are formed through one-side wall surface of the pullout member 131, which are illustrated in FIGS. 4 and 5. Further, the intermediate transfer unit 5 moves down in conjunction with the operation of closing the door 10. As a result, the surfaces of the photosensitive drums 1 come into abutment against the outer circumferential surface of the intermediate transfer unit 5 to receive a pressing force.

The positioned portions 8*d* and 8*e* formed on the both longitudinal ends of the cartridges P illustrated in FIGS. 6 and 8 are pressed against the positioning portions 130*p*, 130*q*, 131*p*, and 131*q* in the following manner. The positioned portions 8*d* and 8*e* are pressed against the positioning portions 130*p* and 130*q* formed on the upper portions of the wall surfaces of the both longitudinal ends of the mounting portion 130*f* of the pullout member 130 and the positioning portions 131*p* and 131*q* formed on the upper portions of the wall surfaces of the both longitudinal ends of the mounting portion 131*f* of the pullout member 131, which are illustrated in FIGS. 4 and 5. In this manner, the positions of the respective cartridges P, which are accommodated in the mounting portion 130*f* of the pullout member 130 and the mounting portion 131*f* of the pullout member 131, are determined inside the main body of the image forming apparatus 100.

<Excellent Points in the Embodiment>

According to the first embodiment, when the cartridge P of a certain color is to be replaced, all the cartridges P mounted into the mounting portion 130*f* of the pullout member 130 and the mounting portion 131*f* of the pullout member 131 are not required to be pulled out of the main body of the image forming apparatus 100. Therefore, excellent convenience is provided.

In the embodiment, as illustrated in FIG. 2, there has been described the example where the pullout unit U1, in which the most frequently used cartridge PK for black K alone is mounted in the pullout member 130, is mounted into the main body of the image forming apparatus 100 independently of the pullout unit U2. However, the cartridge to be mounted in the pullout member 130 is not required to be limited to the cartridge PK for black K.

Further, in the embodiment, there has been described the example where the pullout unit U2, in which the three cartridges PY, PM, and PC for yellow Y, magenta M, and cyan C are mounted in the pullout member 131, is mounted into the main body of the image forming apparatus 100.

Besides, the pullout unit U can be configured so that the pullout member 131 is further divided into two, for example, one for the two cartridges PY and PM for yellow Y and magenta M and the other for the cartridge PC for cyan C.

Further, the pullout unit U can also be divided into two, specifically, one for the cartridge PY for yellow Y and the other for the cartridge PM for magenta M and the cartridge PC for cyan C. The parts obtained by dividing the pullout unit U are mounted into the main body of the image forming apparatus 100 so that each of the parts can be pulled out independently. The details are described later in a second embodiment of the present invention.

Further, in the embodiment, as illustrated in FIG. 1, there has been described the example of the configuration in which the scanner unit 3 is provided inside the main body of the image forming apparatus 100 so that the surfaces of the photosensitive drums 1 are exposed to the laser beams L in accordance with the image information, which are radiated from below the photosensitive drums 1 in FIG. 1. Besides, the scanner unit 3 may be provided inside the main body of the image forming apparatus 100 so that the surfaces of the photosensitive drums 1 are exposed to the laser beams L in accordance with the image information, which are radiated from above the photosensitive drums 1.

Further, in the embodiment, there has been described the example of the cartridge P including the photosensitive member unit 8 and the developing unit 4. Besides, the cartridge P may also be configured by using a cartridge system that allows the photosensitive member unit 8 and the developing unit 4 to be replaced separately.

Further, in the embodiment, the example of an intermediate transfer member has been described as an example of the intermediate transfer unit 5. Besides, the sheet S, which is a transferred material, may be conveyed to the transfer portion in which the surface of the photosensitive drum 1 and the transfer unit are opposed to each other so that the toner image formed on the surface of the photosensitive drum 1 is directly transferred onto the sheet S.

Further, the pullout units U1 and U2 can be pulled out independently. Therefore, even if the capacity of each of the cartridges P increases to increase the weight, the mounting and pullout operation can be easily performed. Moreover, when the pullout units U1 and U2 are pulled out, a gravity of the main body of the image forming apparatus 100 is not shifted. Therefore, the main body of the image forming apparatus 100 does not fall down.

Second Embodiment

Next, a configuration of an image forming apparatus according to a second embodiment of the present invention will be described referring to FIG. 11. Components or members configured similarly to those in the first embodiment described above are denoted by the same reference symbols or are denoted by the same names even though different reference symbols are given, and the description thereof is herein omitted.

In the first embodiment described above, there has been described the example where the pullout unit U1, in which the cartridge PK for black K is mounted in the mounting portion 130*f* of the pullout member 130, is mounted into the main body of the image forming apparatus 100.

On the other hand, an image forming apparatus 300 of the second embodiment includes a pullout member 150 serving as a support member for supporting the cartridges PC and PK. The image forming apparatus 300 includes a pullout unit U3 in which the cartridges PC and PK are mounted in a mounting portion of the pullout member 150.

The image forming apparatus 300 also includes a pullout member 151 serving as a support member for supporting the cartridges PY and PM. The image forming apparatus 300 includes a pullout unit U4 in which the cartridges PY and PM are mounted in a mounting portion of the pullout member 151.

The pullout units U3 and U4 (support members) can be moved independently of each other between an inside position for the main body of the image forming apparatus 300 and an outside position for the main body of the image forming apparatus 300. The pullout members 150 and 151 (support members) are configured so that the two cartridges PY and PM can be mounted and removed in a state in which the pullout member 151 is located in the outside position for the main body of the image forming apparatus 300 and the two cartridges PC and PK can be mounted and removed in a state in which the pullout member 150 is located in the outside position for the main body of the image forming apparatus 300.

Each of the pullout units U3 and U4 (support members) is configured so that the pullout units U3 and U4 can be mounted into and pulled out of the main body of the image forming apparatus 300. A configuration of each of the cartridges P and a configuration of mounting the cartridges P into the pullout members 150 and 151 are the same as those of the first embodiment described above. Therefore, the overlapping description thereof is herein omitted.

Figure 11:
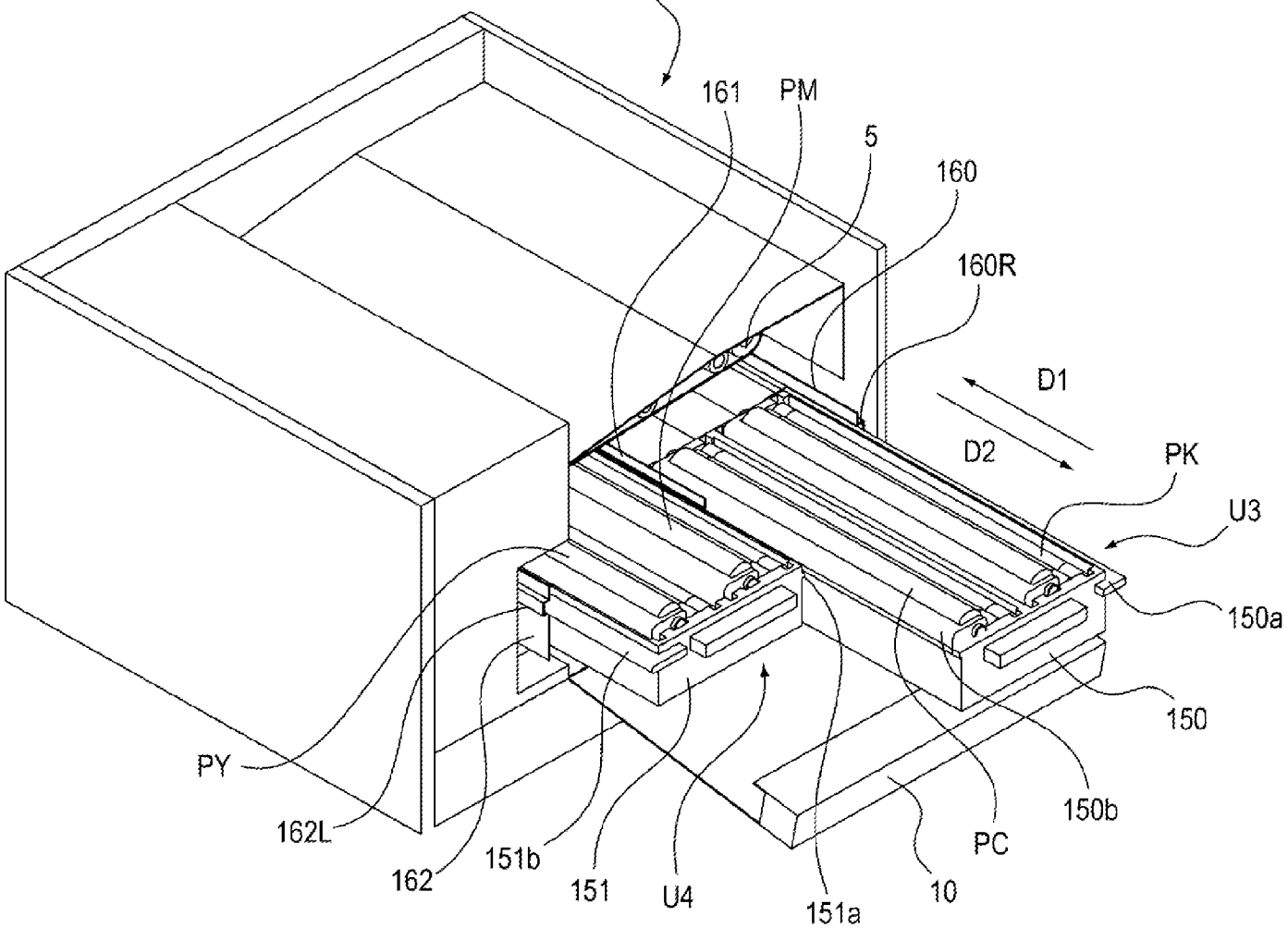
FIG. 11 is a perspective explanatory view for illustrating a state in which a support member according to a second embodiment is being mounted into a main body of an image forming apparatus.

FIG. 11 is a perspective view for illustrating a state in which the pullout units U3 and U4 according to the second embodiment are being pressed into the main body of the image forming apparatus 300 to be mounted therein or being pulled out of the main body of the image forming apparatus 300. As illustrated in FIG. 11, the pullout unit U3 is as follows.

Specifically, guided portions 150*a* and 150*b*, which are flange portions formed on the pullout member 150, are slidably fitted respectively into a guiding portion 160R of a guiding member 160 and an unshown guiding portion of a guiding member 161. Each of the guiding portions is a concave portion having a U-like cross section. The guiding members 160 and 161 are provided on the main body of the main body of the image forming apparatus 300.

Each of the pullout units U3 and U4 can be pressed into the main body of the image forming apparatus 300 in a direction indicated by the arrow D1 in FIG. 11 to be mounted therein and can be pulled out of the main body of the image forming apparatus 300 in a direction indicated by the arrow D2 in FIG. 11. In FIG. 11, the guiding portion 161L is located invisibly.

Even in the second embodiment, the intermediate transfer unit 5 moves up from the image forming position to retract in conjunction with the operation of opening the door 10 provided on the main body of the image forming apparatus 300 so as to be openable and closable, as in the first embodiment. Therefore, during the operation of mounting or pulling out the pullout units U3 and U4, the surfaces of the photosensitive drums 1 and the outer circumferential surface of the intermediate transfer unit 5 do not slide against each other.

The pullout unit U4 has guided portions 151*a* and 151*b*, which are flange portions formed on the pullout member 151. The guided portions 151*a* and 151*b* are formed as follows. The guided portions 151*a* and 151*b* are formed to be slidably fitted respectively into an unshown guiding portion formed on the guiding member 161 and a guiding portion 162L formed on a guiding member 162. The guiding members 161 and 162 are provided on the main body of the image forming apparatus 300. Each of the guiding portions is a concave portion having a U-like cross section.

According to the second embodiment, when the cartridges P for the two colors arranged in the same pullout unit are to be replaced, all the cartridges P mounted into the pullout members 150 and 151 are not required to be pulled out of the main body of the image forming apparatus 300. Therefore, excellent convenience is provided.

In the embodiment, the pullout unit U3, in which the two cartridges PC and PK for cyan C and black K are mounted in the mounting portion of the pullout member 150, is provided. Further, the pullout unit U4, in which the two cartridges PY and PM for yellow Y and magenta M are mounted in the mounting portion of the pullout member 151, is provided. In the embodiment, there has been described the example of the configuration in which the pullout units U3 and U4 can be mounted into and pulled out of the main body of the image forming apparatus 300 independently. The combinations of colors, specifically, yellow Y, magenta M, cyan C, and black K, may be different. Further, the colors of the developers are not limited. The remaining configuration is the same as that of the first embodiment, and the same effects can be obtained.

Specifically, the image forming apparatus 300 includes the plurality of pullout members 150 and 151. Therefore, the number of cartridges to be mounted into one pullout member is small. Therefore, a load is reduced when the user moves each of the pullout members 150 and 151.

On the other hand, each of the pullout members 150 and 151 has a configuration of supporting the plurality of cartridges. Therefore, the number of pullout members to be provided on the image forming apparatus 300 is kept down to a small number (two in this case). Thus, the configuration of the image forming apparatus 300 can be prevented from becoming complex and increasing in size.

Further, even in the embodiment, the cartridge PK for black K, which is highly frequently used, can be pulled out of the main body independently of the cartridge PY for yellow Y and the cartridge PM for magenta M. Thus, a load can be reduced when the cartridge PK for black K is replaced.

However, the pullout member 150 of the embodiment supports not only the cartridge PK for black K but also the cartridge PC for cyan C. Therefore, the load imposed when the pullout member 150 is moved becomes larger than that when the pullout member 130 (see FIG. 2) of the first embodiment is moved. However, there is an advantage in that the load imposed when the pullout member 151, which supports the two cartridges for yellow Y and magenta M, is moved becomes correspondingly smaller than that imposed when the pullout member 131 (see FIG. 2 in the first embodiment), which supports the three cartridges for yellow Y, magenta M, and cyan C, is moved.

Specifically, in the second embodiment, there is provided the configuration in which the load imposed when the cartridge PK for black K is replaced and the load imposed when the other cartridges PY, PM, and PC are replaced are balanced. The pullout members of the first embodiment or the pullout members of the second embodiment can be appropriately selected to be used depending on functions and modes required for the image forming apparatus. It is preferred that the number of cartridges to be supported by each of the pullout members satisfy the following relationship. It is preferred that the number of cartridges to be supported by the pullout member 130 or 150, which supports the cartridge PK for black K, be equal to or smaller than a total number of cartridges supported by the other pullout member 131 or 151.

This is because the load at the time of movement is preferably reduced for the pullout member that is more frequently moved (pullout member that supports the cartridge PK for black K).

Reference Example

Next, a reference configuration for comparison with the configurations of the first embodiment and the second embodiment will be described referring to FIG. 12. Components or members configured similarly to those in the embodiments described above are denoted by the same reference symbols or are denoted by the same names even though different reference symbols are given, and the description thereof is herein omitted.

In the first embodiment described above, there has been described the example where the pullout unit U1, in which the cartridge PK for black K alone is mounted in the mounting portion 130*f* of the pullout member 130, is independently mounted into the main body of the image forming apparatus 100.

Figure 12:
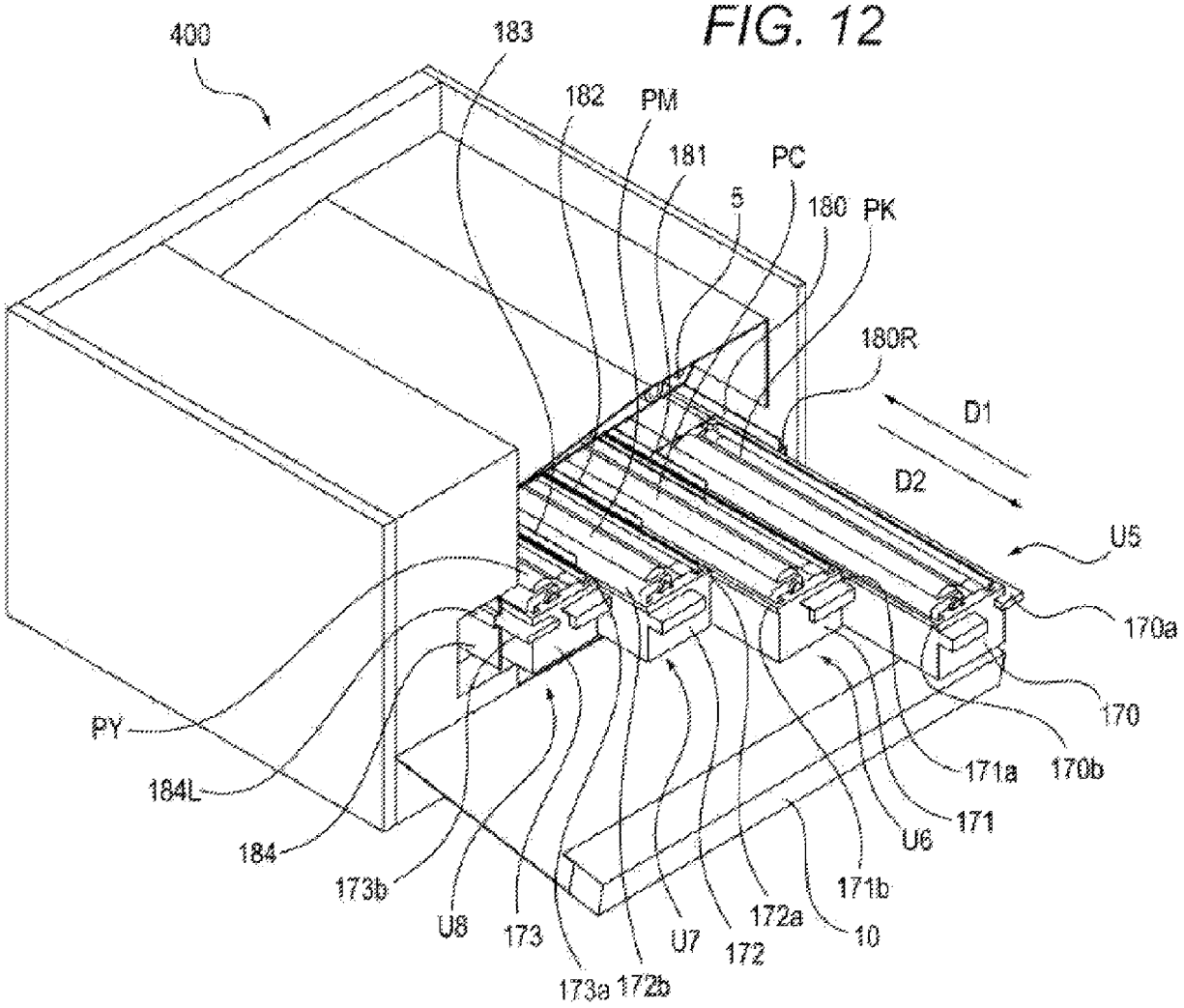
FIG. 12 is a perspective explanatory view for illustrating a state in which support members in a reference example are being mounted into a main body of an image forming apparatus.

In the reference configuration, as illustrated in FIG. 12, the plurality of cartridges P, which can be mounted into and removed from a main body of an image forming apparatus 400, include the following. The cartridge PY for forming an image in yellow Y, the cartridge PM for forming an image in magenta M, the cartridge PC for forming an image in cyan C, and the cartridge PK for forming an image in black K are arranged. The image forming apparatus 400 also includes pullout members 170, 171, 172, and 173, which are a plurality of support members for independently supporting the cartridges PY, PM, PC, and PK.

Each of the pullout members 170 to 173 can be moved independently of each other between an inside position for the main body of the image forming apparatus 400 and an outside position for the main body of the image forming apparatus 400. The pullout members 170 to 173 are configured so that the cartridges PY, PM, PC, and PK can be mounted and removed in a state in which the pullout members 170 to 173 are located in the outside position for the main body of the image forming apparatus 400.

Pullout units U5 to U8, in which the cartridges PY, PM, PC, and PK are respectively mounted in mounting portions of the pullout members 170 to 173, are configured to be movable between the inside position and the outside position for the main body of the image forming apparatus 400.

Specifically, as illustrated in FIG. 12, the pullout unit U5, in which the cartridge PK for black K is mounted in the mounting portion of the pullout member 170, is provided. The pullout unit U6, in which the cartridge PC for cyan C is mounted in the mounting portion of the pullout member 171, is provided. The pullout unit U7, in which the cartridge PM for magenta M is mounted in the mounting portion of the pullout member 172, is provided. The pullout unit U8, in which the cartridge PY for yellow Y is mounted in the mounting portion of the pullout member 173, is provided.

The pullout units U5 to U8 are configured to be mounted into and pulled out of the main body of the image forming apparatus 400 independently. A configuration of each of the cartridges P and a configuration of mounting the cartridges P respectively into the mounting portions of the pullout members 170 to 173 are the same as those of the first embodiment. Therefore, the overlapping description thereof is herein omitted.

FIG. 12 is a perspective view for illustrating a state in which the pullout units U5 to U8 of this reference example are being mounted into the main body of the image forming apparatus 400 or being pulled out of the main body of the image forming apparatus 400. As illustrated in FIG. 12, the pullout unit U5, in which the cartridge PK for black K is mounted in the mounting portion of the pullout member 170, is as follows.

The pullout unit U5 includes guided portions 170*a* and 170*b*. The guided portions 170*a* and 170*b*, which are flange portions formed on the pullout member 170, are as follows. The guided portions 170*a* and 170*b* are fitted into a guiding portion 180R of a guiding member 180 and an unshown guiding portion of a guiding member 181 so as to be mounted in a direction indicated by the arrow D1 in FIG. 12 along the guiding portions. The guiding members 180 and 181 are provided on the main body of the image forming apparatus 400. Each of the guiding portions is a concave portion having a U-like cross section. Alternatively, the guided portions 170*a* and 170*b* can also be pulled out in a direction indicated by the arrow D2.

Even in the reference example, the intermediate transfer unit 5 is moved up from the image forming position to retract in conjunction with the operation of opening the door 10 which is provided on the main body of the image forming apparatus 400 so as to be openable and closable, as in the first embodiment described above. Therefore, during the operation of mounting or pulling out the pullout unit U5, the surface of the corresponding photosensitive drum 1 and the outer circumferential surface of the intermediate transfer unit 5 do not slide against each other.

Similarly, the pullout unit U6 is as follows. The pullout unit U6 includes guided portions 171*a* and 171*b*. The guided portions 171*a* and 171*b*, which are flange portions formed on the pullout member 171, are as follows. The guided portions 171*a* and 171*b* are fitted into an unshown guiding portion of the guiding member 181 and an unshown guiding portion of a guiding member 182 so as to be mounted in the direction indicated by the arrow D1 in FIG. 12 along the guiding portions. The guiding members unshown are provided on the main body of the image forming apparatus 400. Each of the guiding portions is a concave portion having a U-like cross section. Alternatively, the guided portions 171*a* and 171*b* can also be pulled out in the direction indicated by the arrow D2. In FIG. 12, the guiding portions 181R and 182L are located invisibly.

Similarly, the pullout unit U7 is as follows. The pullout unit U7 includes guided portions 172*a* and 172*b*. The guided portions 172*a* and 172*b*, which are flange portions formed on the pullout member 172, are as follows. The guided portions 172*a* and 172*b* are fitted into an unshown guiding portion of the guiding member 182 and an unshown guiding portion of a guiding member 183 so as to be mounted in the direction indicated by the arrow D1 in FIG. 12 along the guiding portions. The guiding members 182 and 183 are provided on the main body of the image forming apparatus 400. Each of the guiding portions is a concave portion having a U-like cross section. Alternatively, the guided portions 172*a* and 172*b* can also be pulled out in the direction indicated by the arrow D2.

Similarly, the pullout unit U8 is as follows. The pullout unit U8 includes guided portions 173*a* and 173*b*. The guided portions 173*a* and 173*b*, which are flange portions formed on the pullout member 173, are as follows. The guided portions 173*a* and 173*b* are fitted into an unshown guiding portion of the guiding member 183 and a guiding portion 184L of a guiding member 184 so as to be mounted in the direction indicated by the arrow D1 in FIG. 12 along the guiding portions. The guiding members 183 and 184 are provided on the main body of the image forming apparatus 400. Each of the guiding portions is a concave portion having a U-like cross section. Alternatively, the guided portions 173*a* and 173*b* can also be pulled out in the direction indicated by the arrow D2.

According to this reference configuration, when the cartridge P of a certain color is to be replaced, all the cartridges P mounted independently in the mounting portions of the pullout members 170 to 173 are not required to be pulled out of the main body of the image forming apparatus 400. Therefore, excellent convenience is provided.

On the other hand, however, the number of movable support members (pullout members 170 to 173) is disadvantageously increased in this reference configuration. Specifically, each of the support members supports only one cartridge in this reference configuration. Thus, the number of support members becomes four so as to correspond to the number of cartridges.

Therefore, in comparison with the first embodiment and the second embodiment, the configuration of the image forming apparatus becomes relatively complex. For keeping user's convenience while reducing the complexity of the image forming apparatus, the configurations of the first embodiment and the second embodiment, each including the pullout member for supporting the plurality of cartridges, are preferred.

The reference configuration includes the pullout unit U5, in which the cartridge PK for black K is mounted in the mounting portion of the pullout member 170. The reference configuration further includes the pullout unit U6, in which the cartridge PC for cyan C is mounted in the mounting portion of the pullout member 171. The reference configuration further includes the pullout unit U7, in which the cartridge PM for magenta M is mounted in the mounting portion of the pullout member 172.

The reference configuration further includes the pullout unit U8, in which the cartridge PY for yellow Y is mounted in the mounting portion of the pullout member 173. There has been described the example of the configuration in which the pullout units U5 to U8 can be independently mounted into or pulled out of the main body of the image forming apparatus 400. Besides, various other orders of arrangement of the colors can be used, and therefore the order of arrangement of the colors is not limited to that described in this reference example. The remaining configuration is the same as that of each of the embodiments described above, and the same effects can be obtained.

Third Embodiment

Next, a configuration of an image forming apparatus according to a third embodiment of the present invention will be described referring to FIGS. 13 to 19. Components or members configured similarly to those in each of the embodiments described above are denoted by the same reference symbols or are denoted by the same names even though different reference symbols are given, and the description thereof is herein omitted.

In the first embodiment described above, the pullout unit U1, in which the cartridge PK for black K is mounted in the mounting portion 130*f* of the pullout member 130, is independently mounted into the main body of the image forming apparatus 100. Alternatively, there has been described the example of the configuration in which the pullout unit U1 can be pulled out of the main body of the image forming apparatus 100. Further, in each of the embodiments described above, the support members (support members, support units) for supporting the respective cartridges P are moved in the direction parallel to the axial direction of the photosensitive drums 1.

Figure 13:
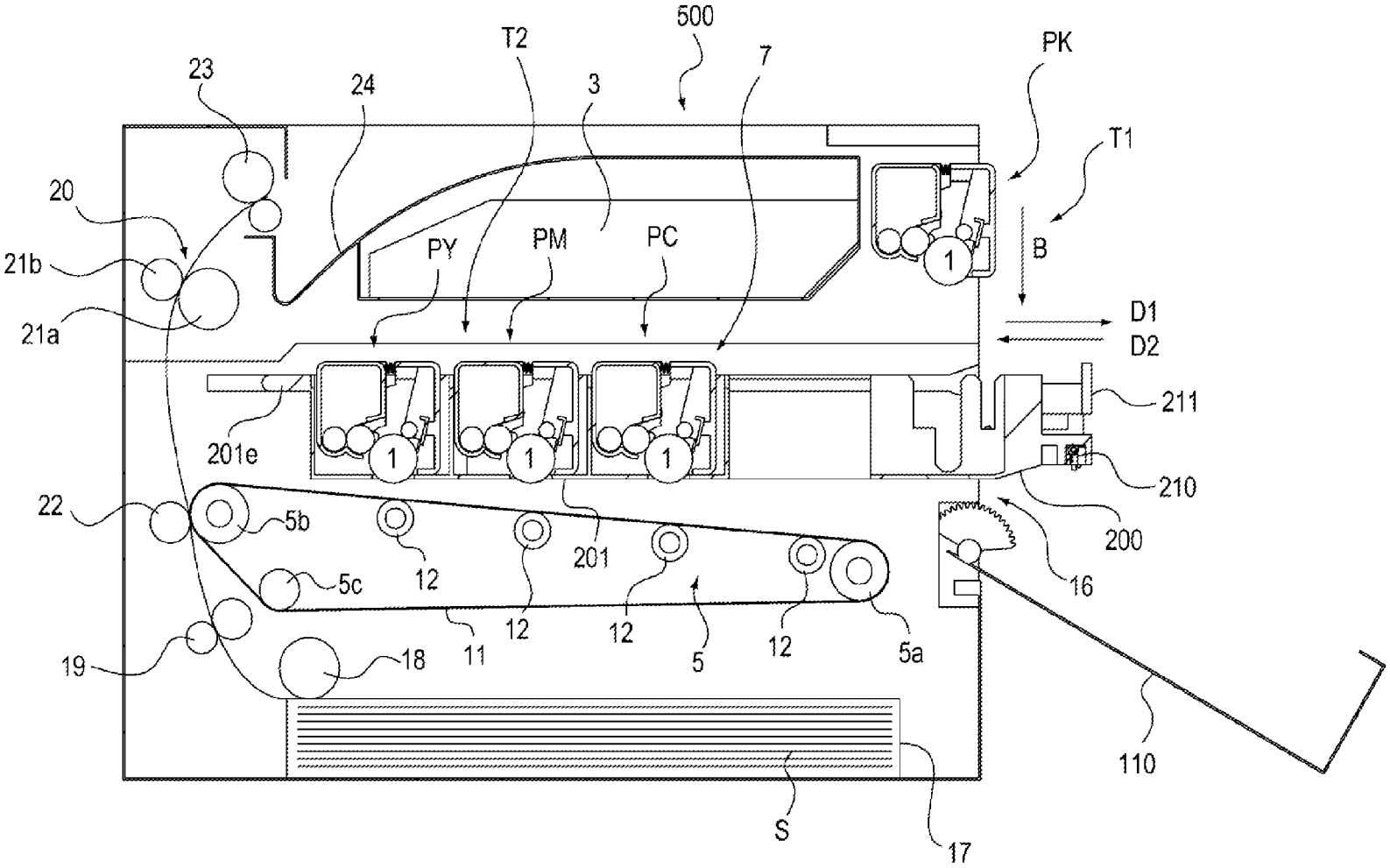
FIG. 13 is a sectional explanatory view for illustrating a state in which a first support member is being mounted into or pulled out of a main body of an image forming apparatus according to a third embodiment.
Figure 14:
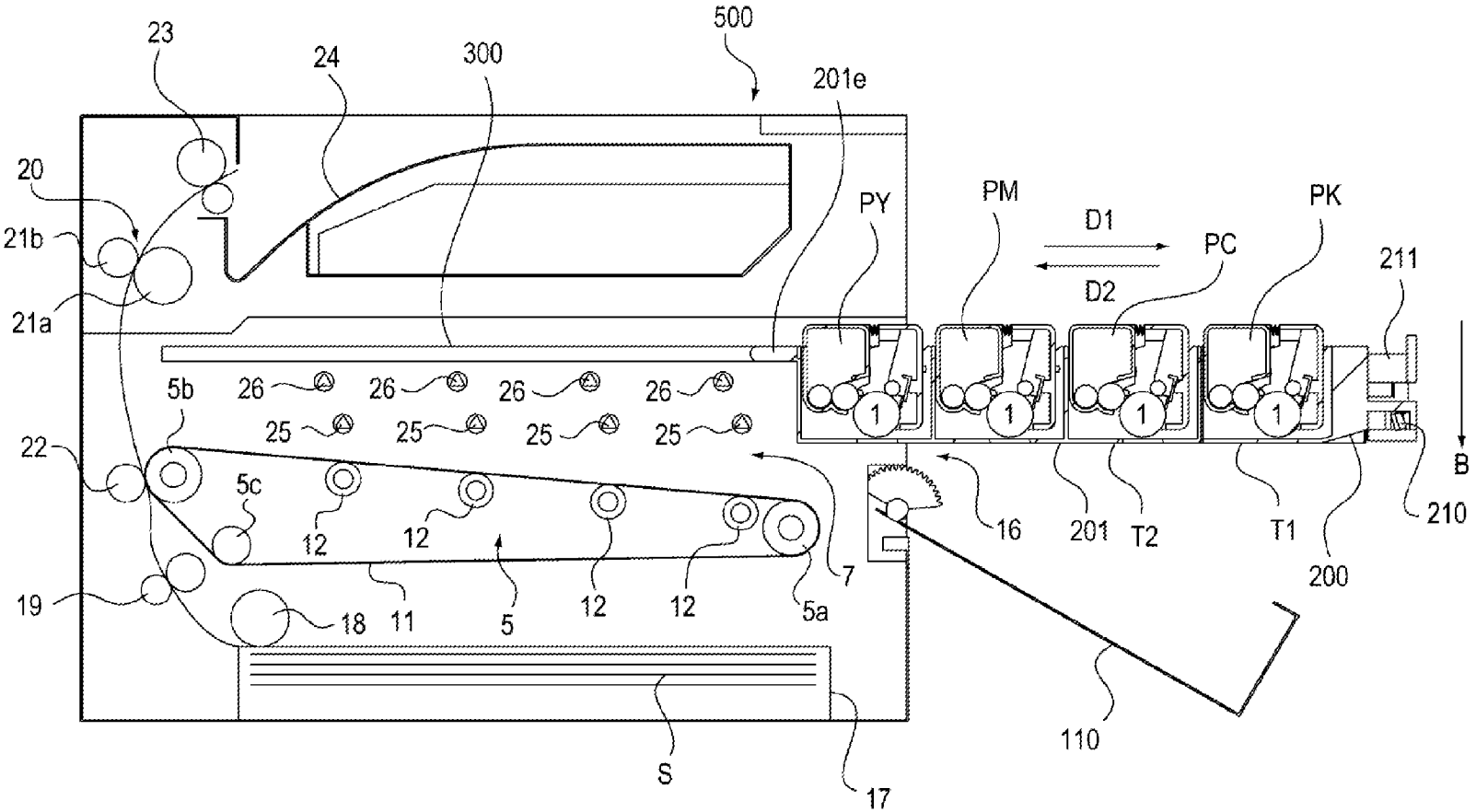
FIG. 14 is a sectional explanatory view for illustrating a state in which the first support member and a second support member are being mounted into or pulled out of the main body of the image forming apparatus according to the third embodiment.

In the embodiment, an image forming apparatus 500 includes a pullout member 200, which is a support member for supporting the cartridge PK for forming an image in black K, as illustrated in FIGS. 13 and 14.

The image forming apparatus 500 further includes the cartridge PY for forming an image in yellow Y, the cartridge PM for forming an image in magenta M, and the cartridge PC for forming an image in cyan C, which are the plurality of colors different from black K. The image forming apparatus 500 includes a pullout member 201, which is a support member for supporting the cartridges PY, PM, and PC.

The pullout members 200 and 201 of the embodiment are moved in a direction orthogonal to the axial direction of the photosensitive drums 1 (crosswise direction in FIGS. 13 and 14). The pullout members 200 and 201 are configured to be pulled out from an inside position for a main body of the image forming apparatus 500 to an outside position for the main body of the image forming apparatus 500, at which the cartridges P can be mounted and removed, through the opening portion 16 formed in the main body of the image forming apparatus 500.

In the embodiment, as illustrated in FIG. 13, the pullout member 200 is supported so as to be movable in a direction indicated by the arrow D1 in FIG. 13, which is a pullout direction for the pullout member 201. The pullout member 200 is provided on a most downstream side (right side in FIG. 13) in the direction indicated by the arrow D1 in FIG. 13, which is the pullout direction.

In the embodiment, the pullout members 200 and 201 are movable with respect to the main body of the image forming apparatus 500 (main body). A pullout unit T1, in which the cartridge PK for black K is mounted in a mounting portion 200*f* of the pullout member 200, is provided on the most downstream side in the pullout direction indicated by the arrow D1 in FIGS. 13 and 14. A configuration of the main body of the image forming apparatus 500 and a configuration of each of the cartridges P are the same as those of the first embodiment described above, and therefore the overlapping description thereof is herein omitted.

<Support Members>

Next, configurations of the pullout members 200 and 201, which are provided on the main body of the image forming apparatus 500 of the embodiment so that the pullout members 200 and 201 can be mounted into and pulled out of the main body of the image forming apparatus 500, are described referring to FIGS. 13 and 14. FIG. 13 is a sectional explanatory view for illustrating a state in which the pullout unit T1 of the third embodiment is being mounted into or pulled out of the main body of the image forming apparatus 500. FIG. 14 is a sectional explanatory view for illustrating a state in which the pullout units T1 and T2 of the third embodiment are being mounted into or pulled out of the main body of the image forming apparatus 500.

As illustrated in FIGS. 13 and 14, the pullout members 200 and 201 are provided so as to be movable (pressed or pulled out) linearly substantially in the horizontal direction indicated by the arrows D1 and D2 in FIGS. 13 and 14 with respect to the main body of the image forming apparatus 500. The pullout members 200 and 201 can be moved to the inside position for the main body of the image forming apparatus 500 or to the outside position for the main body of the image forming apparatus 500.

As illustrated in FIG. 14, the pullout member 200 is located in the outside position for the main body of the image forming apparatus 500. In this state, the cartridge PK for black K is mounted by the user into the mounting portion 200*f* of the pullout member 200 substantially in the gravity direction indicated by the arrow B in FIG. 14.

Similarly, as illustrated in FIG. 14, the pullout member 201 is located in the outside position for the main body of the image forming apparatus 500. In this state, the cartridges PY, PM, and PC for the other colors are mounted by the user into an unshown mounting portion of the pullout member 201 in the gravity direction indicated by the arrow B in FIG. 14.

The cartridges P mounted as described above are arranged so that a longitudinal direction thereof (axial direction of the photosensitive drums 1) becomes a direction orthogonal to a moving direction of the pullout members 200 and 201. The four cartridges PY, PM, PC, and PK are arranged side by side so that the longitudinal direction thereof is oriented in the direction orthogonal to the moving direction of the pullout members 200 and 201.

The cartridges P are moved into the main body of the image forming apparatus 500 together with the pullout members 200 and 201 in a state in which the cartridges P are mounted into the mounting portion 200*f* of the pullout member 200 and the mounting portion 201*f* of the pullout member 201.

Then, the pullout members 200 and 201 are moved into the main body of the image forming apparatus 500. In this state, a door 110, which is provided on the main body of the image forming apparatus 500 so as to be openable and closable, is closed. Then, all the cartridges P are positioned at predetermined positions inside the main body of the image forming apparatus 500.

In the embodiment, when the pullout member 200 is located in the inside position (position inside of the main body), the pullout member 200 is located on a movement path of the pullout member 201. Specifically, in the embodiment, the two pullout members 200 and 201 share the same movement path. The two pullout members 200 and 201 are pulled out of the main body of the image forming apparatus 500 through the same opening portion 16.

With a configuration in which the movement path is shared by the pullout members 200 and 201, the configuration of the image forming apparatus 500 can be prevented from becoming complex or increasing in size even when the image forming apparatus 500 includes a plurality of pullout members.

In the first embodiment and the second embodiment, each of the pullout members is moved along the axis (longitudinal direction) of the photosensitive drums 1. Therefore, different movement paths are required to be provided to the respective pullout members. In the third embodiment, however, the pullout members 200 and 201 are moved in the direction orthogonal to the axis (longitudinal direction) of the photosensitive drums 1. Therefore, the movement path can be shared by the pullout members 200 and 201.

According to the embodiment, however, when the pullout member 201 is moved to the outside position (position outside of the main body), the pullout member 200 is also required to be moved to the outside position (see FIG. 14).

Therefore, the pullout member 200 that supports the highly frequently used (highly frequently replaced) cartridge PK for black K is preferred to be located on the downstream side of the pullout member 201 in the pullout direction (direction indicated by the arrow D1). This configuration is provided so as to allow the pullout member 200 to be independently moved between the outside position and the inside position in a state in which the pullout member 201 remains in the inside position.

<Mounting Portion for Support Members>

Figure 15:
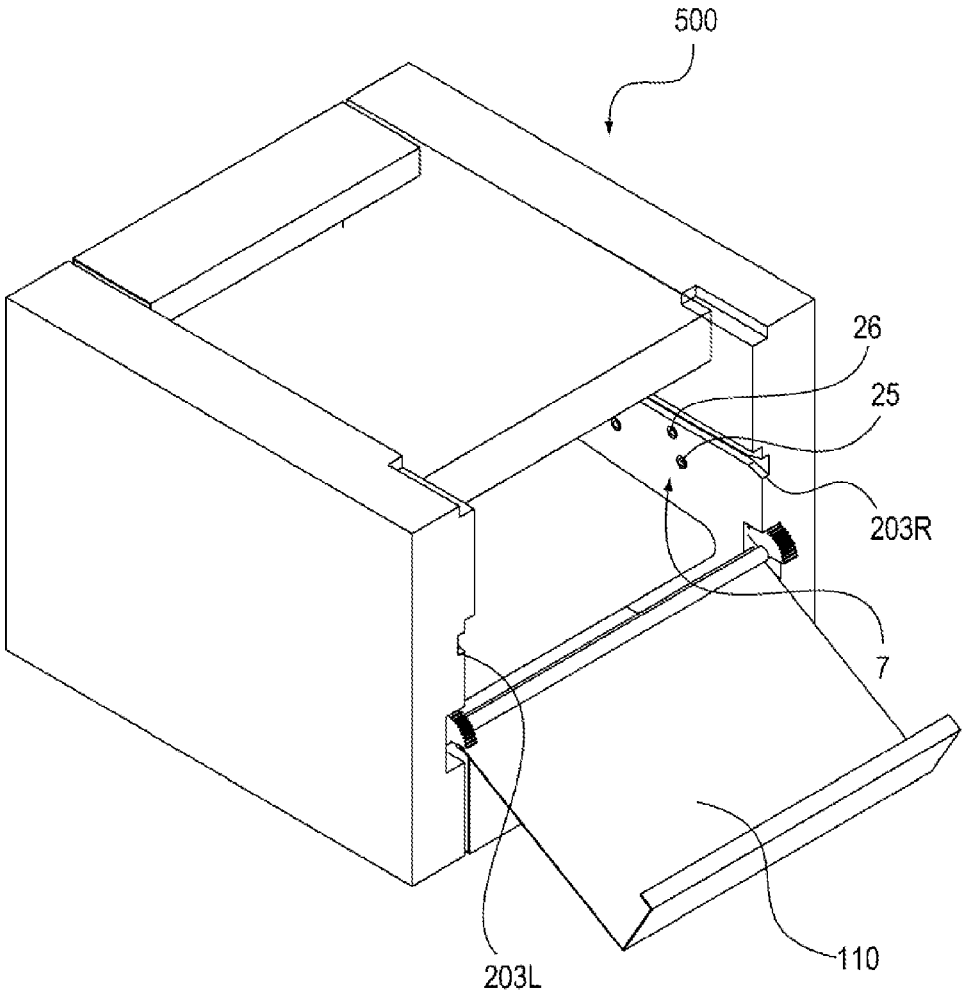
FIG. 15 is a perspective explanatory view for illustrating a configuration of a mounting portion of the main body of the image forming apparatus for the support members according to the third embodiment.

Next, a configuration of the mounting portion 7 of the main body of the image forming apparatus 500 for the pullout members 200 and 201 will be described referring to FIGS. 15 to 17. FIG. 15 is a perspective view for illustrating the configuration of the mounting portion 7 of the main body of the image forming apparatus 500 for the pullout members 200 and 201 according to the embodiment. In FIG. 15, the intermediate transfer unit 5 is omitted from the members (components) constructing the main body of the image forming apparatus 500 for easy understanding of the configuration of the mounting portion 7.

Figure 16:
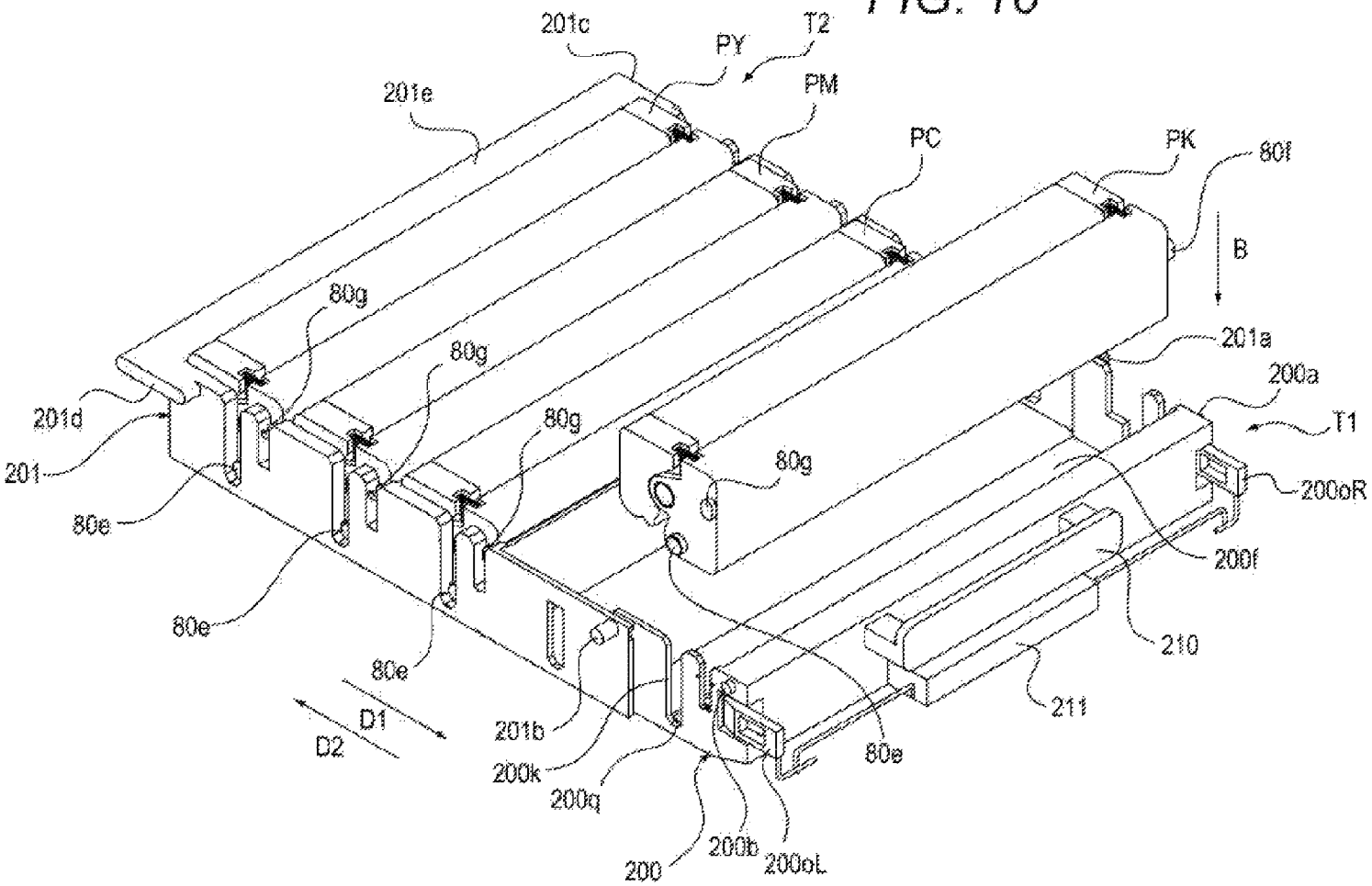
FIG. 16 is a perspective explanatory view for illustrating configurations of the support members according to the third embodiment.
Figure 17:
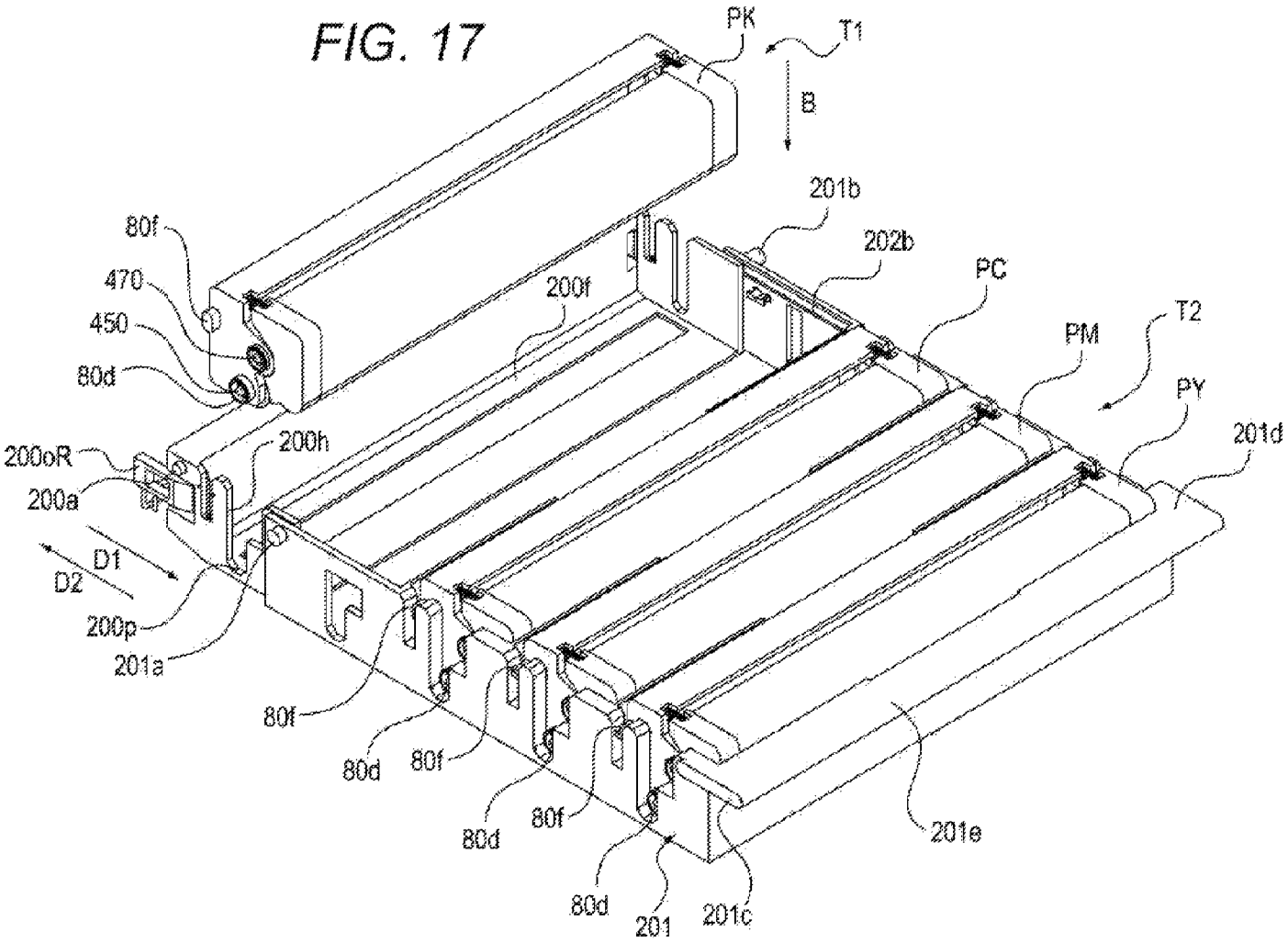
FIG. 17 is another perspective explanatory view for illustrating the configurations of the support members according to the third embodiment.

As illustrated in FIGS. 16 and 17, the pullout member 200 of the embodiment is coupled movably to the pullout member 201 so as to be mounted into the main body of the image forming apparatus 500 integrally. As illustrated in FIG. 15, a pair of guiding portions 203R and 203L is formed on inner wall surfaces of the main body of the image forming apparatus 500. The guiding portions 203R and 203L, each of which is a concave portion having a U-like cross section, guide the pullout member 201 in the moving direction and are formed so as to be opposed to each other.

Guided portions 201*a* and 201*b* illustrated in FIGS. 16 and 17, each having a columnar shape, are slidably fitted into the guiding portions 203R and 203L. The guided portions 201*a* and 201*b* are formed on side walls of the pullout member 201 so as to project therefrom. Further, guided portions 201*c* and 201*d*, which are both longitudinal ends of a flange portion 201*e* formed on a far end portion of the pullout member 201, are slidably fitted into the guiding portions 203R and 203L.

The guiding portions 203R and 203L, which are the concave portions each having the U-like cross section, illustrated in FIG. 15, can guide the pullout member 201 illustrated in FIGS. 16 and 17 from the outside position for the main body of the image forming apparatus 500 to the inside position for the main body of the image forming apparatus 500. The guiding portions 203R and 203L are formed so as to extend in substantially the horizontal direction from the vicinity of the door 110 (vicinity of the inlet) to the far side of the main body of the image forming apparatus (left side in FIG. 15). The door 110 is provided on the main body of the image forming apparatus 500 so as to be openable and closable.

Further, as illustrated in FIG. 15, the development coupling members 26 for transferring the rotational driving force to the developing rollers 40 are provided below the guiding portion 203R. Further, below the development coupling members 26, the drum coupling members 25 for transferring the rotational driving force to the photosensitive drums 1 are provided. The drum coupling members 25 are provided at equal intervals in the horizontal direction so as to correspond to the four cartridges PY, PM, PC, and PK. Similarly, the development coupling members 26 are provided at equal intervals in the horizontal direction so as to correspond to the four cartridges PY, PM, PC, and PK.

The drum coupling members 25 and the development coupling members 26 illustrated in FIG. 15 are subject to the rotational driving force from the motor, which is a driving source (not shown) provided on the main body of the image forming apparatus 500. The drum coupling members 25 and the development coupling members 26 transfer the rotational driving force to the photosensitive drums 1 and the developing rollers 40 rotatably provided on the respective cartridges P.

The drum coupling members 25 and the development coupling members 26 are in a retracted state inside the side walls of the main body of the image forming apparatus 500 in a state in which the door 110 illustrated in FIG. 15 is opened. In conjunction with the operation of closing the door 110, the drum coupling members 25 and the development coupling members 26, which are retracted inside the side walls of the main body of the image forming apparatus 500, project. Then, the drum coupling members 25 and the development coupling members 26 move toward first coupling members 470 and second coupling members 450 provided on the cartridges P illustrated in FIG. 17 to be engaged therewith.

In this manner, the rotational driving force from the motor, which is the driving source (not shown) provided on the main body of the image forming apparatus 500, is transferred to the drum coupling members 25 and the development coupling members 26. Then, the rotational driving force is transferred to the developing rollers 40 and the photosensitive drums 1 respectively through the first coupling members 470 and the second coupling members 450. In this manner, the developing rollers 40 and the photosensitive drums 1 are rotationally driven.

<Support Members>

Next, a configuration of each of the pullout members 200 and 201 according to the embodiment will be described referring to FIGS. 13 to 17. FIG. 16 is a perspective view for illustrating the configurations of the pullout members 200 and 201 that are provided so that the pullout members 200 and 201 can be mounted into and pulled out of the main body of the image forming apparatus 500 of the embodiment. FIG. 17 is a perspective view of the pullout members 200 and 201 illustrated in FIG. 16 as viewed from the opposite side.

As illustrated in FIGS. 16 and 17, the guided portions 201*a* to 201*d* are formed on four corners of the pullout member 201. The guided portions 201*a* to 201*d* are guided by the guiding portions 203R and 203L, which are formed on the inner wall surfaces of the main body of the image forming apparatus 500 and are concave portions each having a U-like cross section as shown in FIG. 15.

Each of the guided portions 201*a* and 201*b* illustrated in FIGS. 16 and 17 is formed to have a columnar shape that projects outward from the side wall of the pullout member 201. The guided portions 201*c* and 201*d* are formed on the far side of the main body of the image forming apparatus 500. The guided portions 201*c* and 201*d* are both longitudinal ends of the flange portion 201*e* that projects outward from the side wall of the pullout member 201.

The guided portions 201*a* and 201*c*, which project outward from one of the side walls of the pullout member 201 as illustrated in FIG. 17, are slidably fitted into the guiding portion 203R formed on the right wall surface of the main body of the image forming apparatus 500 illustrated in FIG. 15 so as to be guided.

The guided portions 201*b* and 201*d*, which project outward from another side wall of the pullout member 201 as illustrated in FIG. 16, are slidably fitted into the guiding portion 203L formed on the left wall surface of the main body of the image forming apparatus 500 illustrated in FIG. 15 so as to be guided.

The flange portion 201*e* is formed on the pullout member 201 illustrated in FIGS. 16 and 17 on the far side of the main body of the image forming apparatus 500. The guided portions 201*c* and 201*d* are formed on both longitudinal ends of the flange portion 201*e* so as to extend in the pullout direction of the pullout member 201 (crosswise direction in FIG. 14), as illustrated in FIG. 14.

The guided portions 201*c* and 201*d* of the pullout member 201 are slidably fitted respectively into the guiding portions 203R and 203L formed on the inner wall surfaces of the main body of the image forming apparatus 500 on both sides. In this manner, the pullout member 201 is configured so as not to be inclined in a state in which the pullout member 201 is pulled out of the main body of the image forming apparatus 500.

As illustrated in FIGS. 13 and 14, the pullout unit T1, in which the cartridge PK for black K is mounted in the mounting portion 200*f* of the pullout member 200, is as follows in the embodiment. The pullout member T1 is provided so that the pullout member T1 can be mounted and pulled out with respect to the pullout unit T2, in which the cartridges PY, PM, and PC for the other colors are mounted in the mounting portion 201*f* of the pullout member 201.

As illustrated in FIG. 17, guiding portions 202*a* and 202*b* for guiding the mounting of the pullout member 200 are formed on inner wall surfaces of the pullout member 201. The guiding portions 202*a* and 202*b* are concave portions each having a U-like cross section. On the other hand, guided portions including guided portion 200*a* are formed on outer wall surfaces of the pullout member 200 so as to project therefrom. The guided portions are slidably fitted into the guiding portions 202*a* and 202*b*.

As illustrated in FIG. 16, the following is provided on the outer wall surface of the pullout member 200, which is located on the opening side of the main body of the image forming apparatus 500. Specifically, grip portions 211 and 210 are provided. The grip portion 211 allows the user to operate the pullout unit T1 alone, whereas the grip portion 210 allows the user to operate the pullout members T1 and T2 together.

As illustrated in FIG. 17, the mounting portion 200*f* for mounting the cartridge PK for black K is formed in the pullout member 200. Further, the mounting portion 201*f* for mounting the cartridges P for the other colors is formed in the pullout member 201. The mounting portions 200*f* and 201*f* are provided in one row along the directions indicated by the arrows D1 and D2 in FIGS. 16 and 17 that are the pullout direction and the mounting direction of the pullout units T1 and T2. In FIGS. 16 and 17, the mounting portion 201*f* is located invisibly.

As illustrated in FIGS. 16 and 17, the following is provided to both longitudinal ends of the mounting portion 200*f* of the pullout member 200. Specifically, guiding portions 200*h* to 200*k* are formed so that the cartridge PK for black K is mounted in the mounting portion 200*f* of the pullout member 200. The guiding portions 200*h* to 200*k* are concave portions each having a U-like cross section. Each of the guiding portions 200*h* to 200*k* extends in a vertical direction indicated by the arrow B in FIGS. 16 and 17.

A positioning portion 200*p* is formed on the guiding portion 200*h* and a positioning portion 200*q* is formed on the guiding portion 200*k* as illustrated in FIGS. 16 and 17. The positioning portions 200*p* and 200*q* are U-shaped grooves for positioning the cartridge PK for black K with respect to the pullout member 200. Positioned portions 80*d* and 80*e*, which are formed on both longitudinal ends of the cartridge PK for black K so as to project therefrom, are fitted into the positioning portions 200*p* and 200*q*. In this manner, the both longitudinal ends of the cartridge PK for black K are positioned.

As illustrated in FIG. 17, an outer circumference of the second coupling member 450 provided on a longitudinal end of each of the cartridges P is covered with a cylindrical rib to form the positioned portion 80*d*. Further, as illustrated in FIG. 16, the guided portion 80*e*, which is formed as a cylindrical projection, is formed on a longitudinal end of each of the cartridges P, which is on the side opposite to the side where the positioned portion 80*d* is formed.

Further, as illustrated in FIG. 17, a rotation regulated portion 80*f* having an oval cross section, which determines an attitude of each of the cartridges P, is formed. Further, as illustrated in FIG. 16, a rotation regulated portion 80*g* having an oval cross section, is formed on a longitudinal end of each of the cartridges P, which is on the side opposite to the side where the rotation regulated portion 80*f* is formed.

As illustrated in FIGS. 16 and 17, the rotation regulated portions 80*f* and 80*g* respectively formed on the longitudinal ends of each of the cartridges P are formed to have a columnar shape with an oval cross section that is elongated in the direction indicated by the arrow B in FIGS. 16 and 17. The positioned portions 80*d* and 80*e* and the rotation regulated portions 80*f* and 80*g*, which are formed on the longitudinal ends of each of the cartridges P, have a function of positioning the cartridges P in the mounting portion 200*f* of the pullout member 200 and the mounting portion 201*f* of the pullout member 201.

The pullout member 200, in which the cartridge PK for black K is mounted in the mounting portion 200*f*, is configured as the pullout unit T1. Then, the pullout member 200 can be pulled out independently as illustrated in FIG. 13 or integrally with the pullout member 201 as illustrated in FIG. 14 to the outside position for the main body of the image forming apparatus 500.

Further, the pullout member 201, in which the cartridges P for the other colors are mounted in the mounting portion 201*f*, can be similarly pulled out integrally with the pullout member 200 to the outside position for the main body of the image forming apparatus 500, as illustrated in FIG. 14, as the pullout unit U2.

When the user grips and operates the grip portion 211 illustrated in FIG. 16, regulating members 200*o*R and 200*o*L provided on both longitudinal ends of the pullout member 200 are disengaged.

<Coupling Portion for Support Members>

Figure 18:
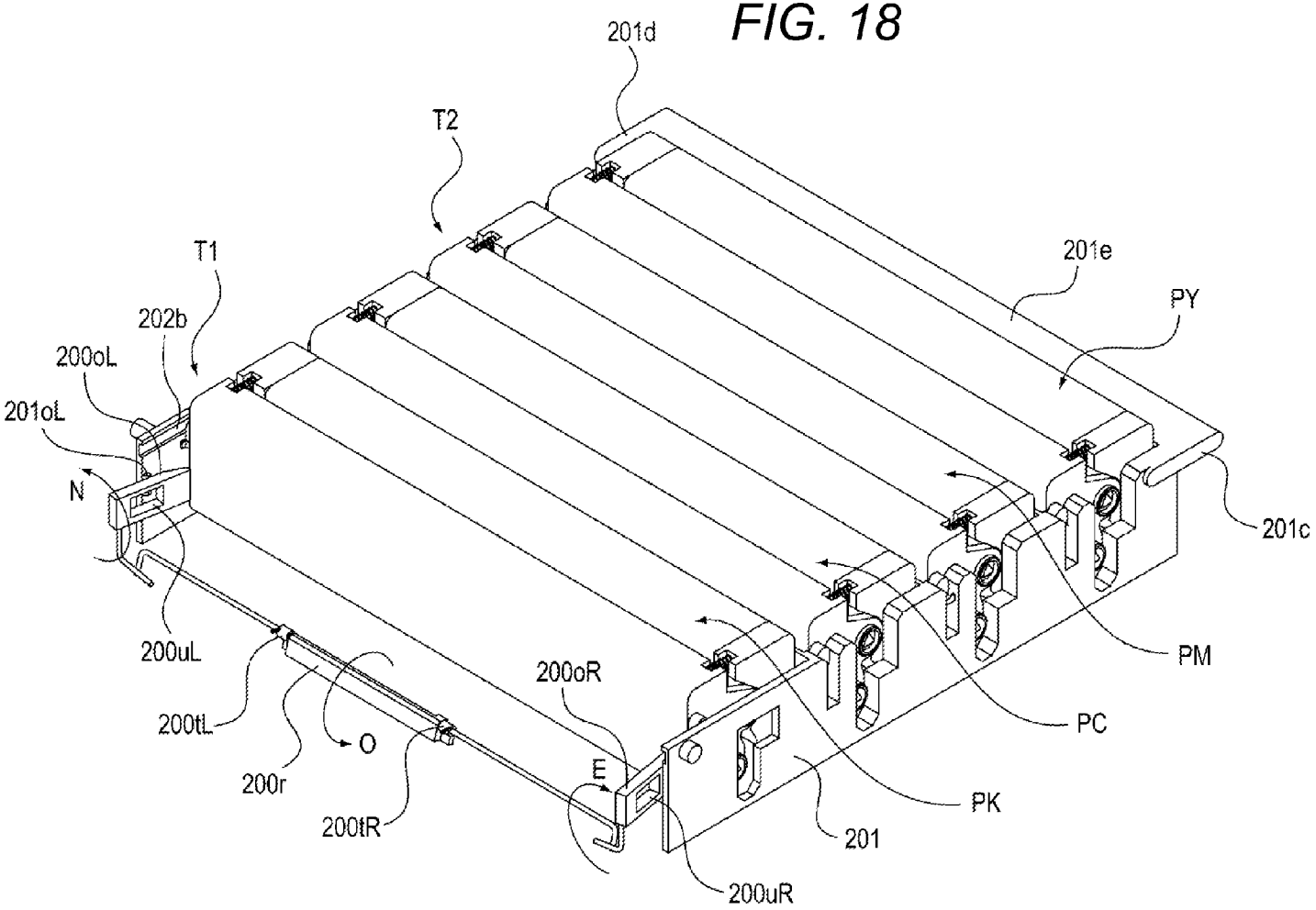
FIG. 18 is a view for illustrating a configuration of an engagement/disengagement mechanism for pulling out the first support member and the second support member according to the third embodiment.
Figure 19:
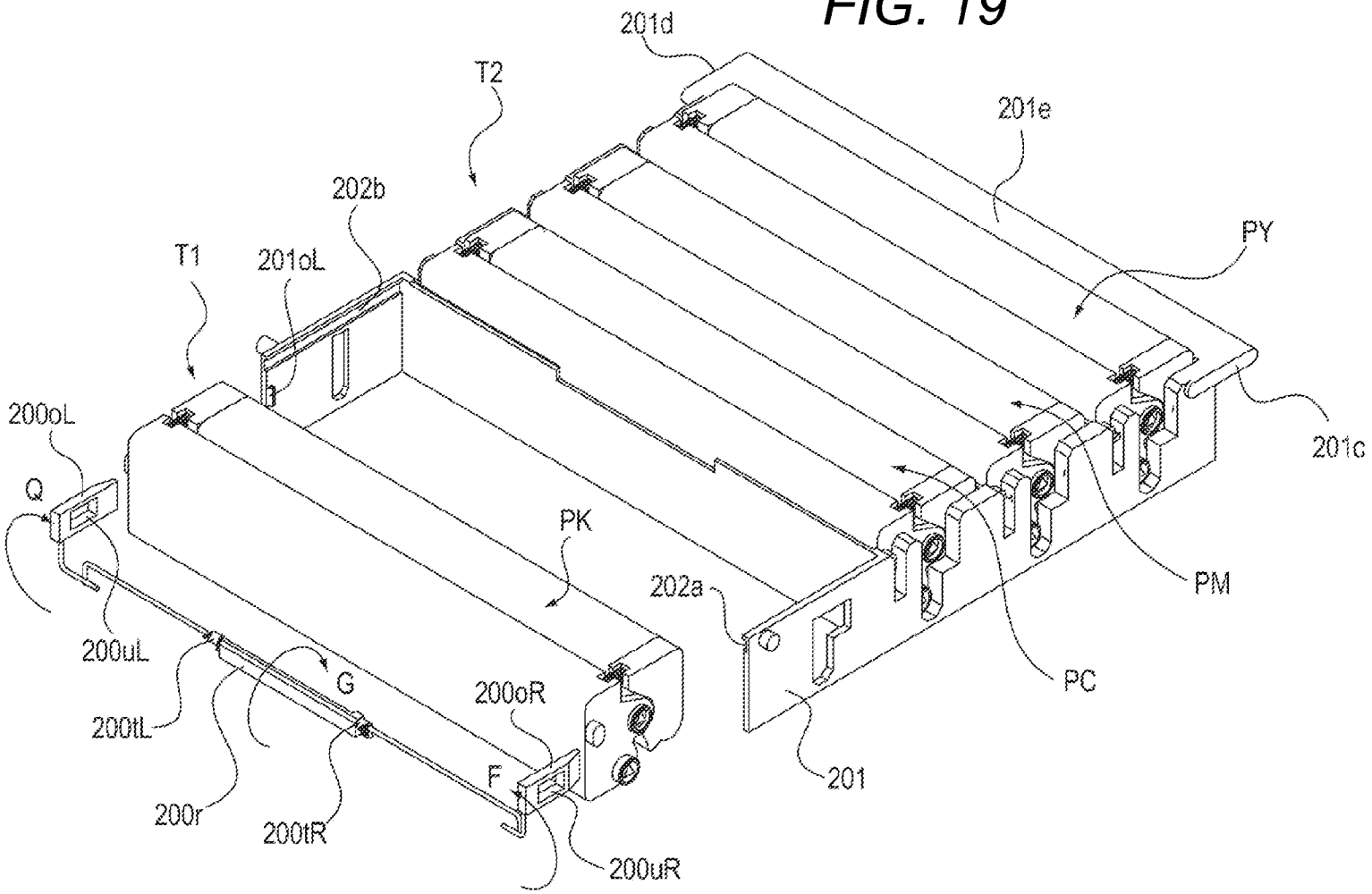
FIG. 19 is another view for illustrating the configuration of the engagement/disengagement mechanism for pulling out the first support member and the second support member according to the third embodiment.

Next, a configuration of a coupling portion for the pullout member 200 and the pullout member 201 will be described referring to FIGS. 18 and 19. FIG. 18 is a perspective view for illustrating a configuration when the pullout units T1 and T2 are coupled to each other in the image forming apparatus 500 according to the third embodiment. FIG. 19 is a perspective view for illustrating a configuration when the coupling between the pullout units T1 and T2 is released in the image forming apparatus 500 according to the third embodiment.

For convenience of the description of the coupling portion between the pullout members 200 and 201, the grip portions 210 and 211 illustrated in FIG. 16 and a frame for the pullout member 200 are omitted in FIGS. 18 and 19.

As illustrated in FIG. 18, the pullout members 200 and 201 are coupled to each other as follows. A concave portion 200*u*R of the regulating member 200*o*R and a concave portion 200*u*L of the regulating member 200*o*L, which are provided on the pullout member 200, are respectively fitted to and brought into abutment against regulating portions formed on inner wall surfaces of the pullout member 201 so as to project therefrom. The regulating members 200*o*R and 200*o*L are constantly biased by biasing members (not shown) respectively in a direction indicated by the arrow E and a direction indicated by the arrow N in FIG. 18.

A link member 200*r* provided integrally with the grip portion 211 illustrated in FIG. 16 provided on the pullout member 200 is constantly biased by biasing members 200*t*R and 200*t*L in a direction indicated by the arrow O in FIG. 18.

As illustrated in FIG. 19, the coupling between the pullout members 200 and 201 is released as follows. Through a user's operation of pulling the link member 200*r* provided integrally with the grip portion 211 illustrated in FIG. 16 toward the user, the link member 200*r* rotates in a direction indicated by the arrow G in FIG. 19.

In conjunction with the operation described above, the regulating member 200*o*R rotates in a direction indicated by the arrow F in FIG. 19, whereas the regulating member 200*o*L rotates in a direction indicated by the arrow Q in FIG. 19. At this time, the fitting-abutment between each of the concave portion 200*u*R of the regulating member 200*o*R and the concave portion 200*u*L of the regulating member 200*o*L and each of the regulating portions 201*o*R and 201*o*L, which are formed on the inner wall surfaces of the pullout member 201 so as to project therefrom, is released. Then, as illustrated in FIG. 13, the pullout unit T1 can be separated from the pullout unit T2 to be pulled out.

In this manner, the pullout unit T1 alone can be pulled out independently to the outside position for the main body of the image forming apparatus 500 while the pullout unit T2 is left in the inside position for the main body of the image forming apparatus 500, as illustrated in FIG. 13.

On the other hand, when the user grips and operates the grip portion 210 illustrated in FIG. 16, the regulating members 200*o*R and 200*o*L provided on the both longitudinal ends of the pullout member 200 are not disengaged. Then, the pullout units T1 and T2 can be pulled out integrally to the outside position for the main body of the image forming apparatus 500.

Similarly to the first embodiment described above, the door 110, which is provided on the main body of the image forming apparatus 500 so as to be openable and closable, is opened in the embodiment. In conjunction with the operation, the intermediate transfer unit 5 illustrated in FIGS. 13 and 14 is moved down in FIGS. 13 and 14 by the moving unit (not shown) so as to be retracted from the image forming position.

Therefore, at the time of the operation of mounting and pulling out the pullout units T1 and T2, the surfaces of the photosensitive drums 1 and the outer circumferential surface of the intermediate transfer belt 11 of the intermediate transfer unit 5 do not slide against each other.

According to the embodiment, the cartridge PK for black L alone can be mounted at the inside position for the main body of the image forming apparatus 500 or pulled out to the outside position for the main body of the image forming apparatus 500. Therefore, the four cartridges P are not required to be pulled out together. Thus, only the cartridge PK for black K, which is highly frequently used, can be replaced.

Therefore, in contrast to the configuration in which the four cartridges P are pulled out together, excellent workability in replacement is provided in a case where the capacity of each of the cartridges P is increased to increase the weight. Further, by arranging the cartridge PK for black K on the downstream side in the pullout direction for the pullout units T1 and T2, excellent convenience is provided when the cartridge PK for black K, which is highly frequently used, is replaced.

In the embodiment, there has been described the example where the pullout unit T1, in which the cartridge PK for black K is mounted in the mounting portion 200*f* of the pullout member 200, is mounted in the main body of the image forming apparatus 500. Besides, the cartridge to be mounted in the mounting portion 200*f* of the pullout member 200 is not limited to the cartridge PK for black K. The cartridge P for another color may be mounted in the mounting portion 200*f* of the pullout member 200.

Further, in the embodiment, there has been described the example of the configuration in which the scanner unit 3 is provided in the main body of the image forming apparatus 500 so that the light beams are radiated from above the photosensitive drums 1 for light exposure. Besides, the scanner unit 3 may be provided in the main body of the image forming apparatus 500 so that the light beams are radiated from below the photosensitive drums 1 for light exposure.

Further, in the embodiment, there has been described the example of the intermediate transfer member as an example of the intermediate transfer unit 5. Besides, the present invention may be applied to such a direct transfer method that the sheet S, which is a transferred material, is conveyed to the transfer portion in which the surface of the photosensitive drum 1 and the transfer unit are opposed to each other so that the toner image formed on the surface of the photosensitive drum 1 is directly transferred onto the sheet S. The remaining configuration is the same as that of each of the embodiments described above, and the same effects can be obtained.

Fourth Embodiment

Next, a configuration of an image forming apparatus according to a fourth embodiment of the present invention will be described referring to FIG. 20. Components or members configured similarly to those in each of the embodiments described above are denoted by the same reference symbols or are denoted by the same names even though different reference symbols are given, and the description thereof is herein omitted.

In the first embodiment described above, there has been described the example where the pullout unit U1, in which the cartridge PK for black K is mounted in the mounting portion 130*f* of the pullout member 130, is mounted into the main body of the image forming apparatus 100. Further, there has been described the example where each of the cartridges P is a process cartridge in which the photosensitive drum 1 is provided integrally.

Figure 20:
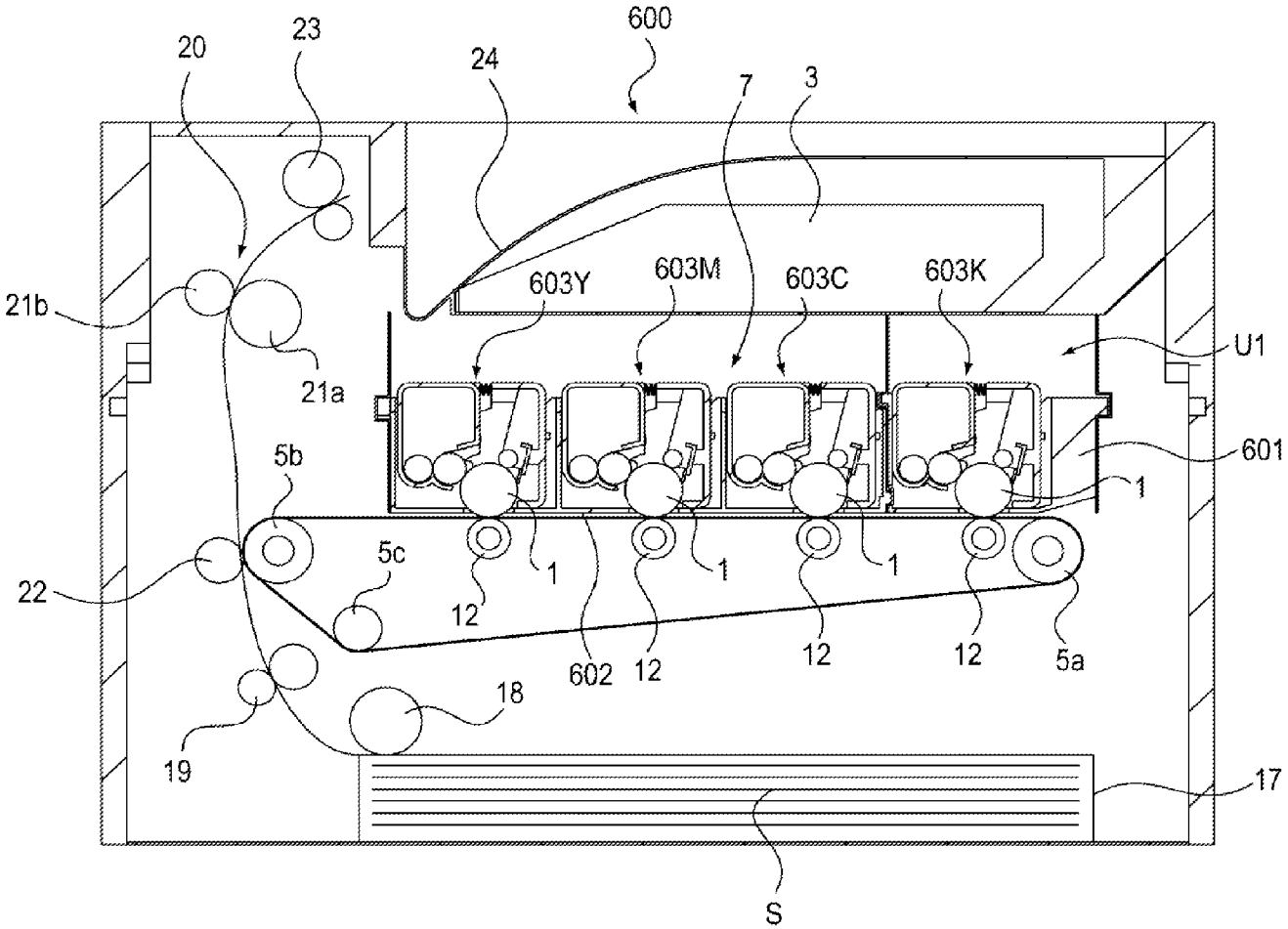
FIG. 20 is a sectional explanatory view for illustrating a configuration of an image forming apparatus according to a fourth embodiment.

In the fourth embodiment, as illustrated in FIG. 20, the photosensitive drums 1 serving as the photosensitive members on which the electrostatic latent images are formed are provided integrally in pullout members 601 and 602 serving as support members. Specifically, the photosensitive drums 1 are fixed to the pullout members 601 and 602.

A developing cartridge 603Y for containing a developer for yellow Y, a development cartridge 603M for containing a developer for magenta M, a developing cartridge 603C for containing a developer for cyan C, and a developing cartridge 603K for containing a developer for black K are configured to be mountable into and removable from the pullout members 601 and 602. Each of the developing cartridges 603 has a developing roller for developing the latent image.

A configuration of a main body of an image forming apparatus 600, a configuration of each of the developing cartridges 603, and configurations of the pullout members 601 and 602 of the embodiment are as follows. The configurations are substantially the same as those of the first embodiment described above except that each of the photosensitive drums 1 and the pullout members 601 and 602 are formed integrally. Therefore, the overlapping description thereof is herein omitted.

For example, the plurality of developing cartridges 603, which can be mounted into and removed from the main body of the image forming apparatus 600, include the developing cartridge 603K that is used in an image forming portion for black K. The image forming apparatus 600 includes the pullout member 601 serving as the support member that supports the developing cartridge 603K and the photosensitive drum 1 on which the electrostatic latent image is formed so as to correspond to the developing cartridge 603K. The developing cartridge 603K is mountable into and removable from the pullout member 601.

The image forming apparatus 600 further includes the plurality of developing cartridges 603Y, 603M, and 603C for forming images in colors (yellow, cyan, and magenta) different from black. The image forming apparatus 600 further includes the pullout member 602 serving as the support member that supports the developing cartridges 603Y, 603M, and 603C and the plurality of photosensitive drums 1 on which the electrostatic latent images are formed so as to correspond to the developing cartridges. Each of the developing cartridges 603Y, 603M, and 603C is mountable into and removable from the pullout member 602.

Each of the pullout members 601 and 602 is moved in the direction parallel to the axial direction of the photosensitive drums 1. Then, each of the pullout members 601 and 602 can be configured to be pulled out from the inside position for the main body of the image forming apparatus 600 to the outside position for the main body of the image forming apparatus 600, at which the developing cartridges 603 can be mounted and removed, through the opening portion 16 formed in the main body of the image forming apparatus 600.

Each of the pullout members (support members) 601 and 602 is moved in the direction parallel to the axial direction of the photosensitive drums 1. The pullout members 601 and 602 can also be configured to be pulled out from the inside position for the main body of the image forming apparatus 600 to the outside position for the main body of the image forming apparatus 600, at which the development cartridges 603 can be mounted and removed, through the opening portion 16 formed in the main body of the image forming apparatus 600.

The pullout members 601 and 602 can be moved independently between the inside position for the main body of the image forming apparatus 600 and the outside position for the main body of the image forming apparatus 600. The developing cartridges 603 can be mounted and removed in a state in which the pullout members 601 and 602 are located in the outside position for the main body of the image forming apparatus 600.

In the embodiment, there has been described the example of the configuration in which the scanner unit 3 is provided in the main body of the image forming apparatus 600 so that the light beams are radiated from above each of the photosensitive drums 1 for light exposure. Besides, the scanner unit 3 may be provided in the main body of the image forming apparatus 600 so that the light beams are radiated from below the photosensitive drums 1 for light exposure.

According to the embodiment, when the developing cartridge 603K for black K, which is highly frequently used, is to be replaced, the developing cartridges 603 mounted in the pullout members 601 and 602 are not all required to be pulled out of the main body of the image forming apparatus 600. Therefore, excellent convenience is provided.

Finally, the effects of the embodiments described above are summarized as follows. According to each of the embodiments described above, usability when the user pulls out each of the support members to the outside position for the main body of the image forming apparatus can be improved with the simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-110758, filed May 29, 2014, and Japanese Patent Application No. 2015-086632, filed Apr. 21, 2015, which are hereby incorporated by reference herein in their entirety.

What is claimed is:

1. An image forming apparatus, comprising:

a plurality of image forming portions configured to form images of colors different from one another;

a first support member movable with respect to a main body of the image forming apparatus in a state in which the first support member supports a plurality of cartridges; and a second support member movable with respect to the main body independently of the first support member in a state in which the second support member supports a cartridge different from the plurality of cartridges supported by the first support member, wherein the plurality of cartridges supported by the first support member and the cartridge supported by the second support member are used in the plurality of image forming portions different from one another, respectively, each of the first support member and the second support member is movable between an inside position located inside of the main body and an outside position located outside of the main body, the second support member is located on a movement locus of the first support member when the second support member is located in the inside position, and each of the plurality of cartridges supported by the first support member and the cartridge supported by the second support member is removably mountable in a state in which the first support member and the second support member are located in the outside position.

2. An image forming apparatus according to claim 1, wherein the second support member is located on a downstream side of the first support member in a moving direction in which the first support member is moved from the inside position to the outside position.

3. An image forming apparatus according to claim 1, wherein the second support member is moved to the outside position to move the first support member to the outside position.

4. An image forming apparatus according to claim 1, wherein the image forming apparatus is operable in a monochrome mode in which the image is formed only by one of the plurality of image forming portions, and the cartridge supported by the second support member is used in the one of the plurality of image forming portions which forms the image in the monochrome mode.

5. An image forming apparatus according to claim 1, wherein the cartridge supported by the second support member is used in one of the plurality of image forming portions which forms an image in black.

6. An image forming apparatus according to claim 1, wherein the plurality of cartridges supported by the first support member are used in the plurality of image forming portions which form an image in yellow, an image in magenta, and an image in cyan, respectively.

7. An image forming apparatus according to claim 1, wherein only one cartridge is supported by the second support member.

8. An image forming apparatus according to claim 1, wherein the second support member supports a plurality of cartridges; and a number of the plurality of cartridges supported by the second support member is equal to or smaller than a number of the plurality of cartridges supported by the first support member.

9. An image forming apparatus according to claim 1, wherein each of the plurality of cartridges supported by the first support member and the cartridge supported by the second support member comprises an image bearing member configured to bear an image.

10. An image forming apparatus according to claim 1, wherein each of the plurality of cartridges supported by the first support member and the cartridge supported by the second support member comprises a developer carrying member configured to develop a latent image.

11. An image forming apparatus according to claim 1, wherein the plurality of cartridges supported by the first support member and the cartridge supported by the second support member contain developers of colors different from one another, respectively.

12. An image forming apparatus, comprising:

a plurality of image forming portions configured to form images of colors different from one another, each of the plurality of image forming portions comprising an image bearing member configured to bear an image;

a first support member movable with respect to a main body of the image forming apparatus in a state in which the first support member supports a cartridge; and a second support member movable with respect to the main body independently of the first support member in a state in which the second support member supports a cartridge different from the cartridge supported by the first support member, wherein the cartridge supported by the first support member and the cartridge supported by the second support member are used in the plurality of image forming portions different from one another, respectively, each of the first support member and the second support member is movable between an inside position located inside of the main body and an outside position located outside of the main body along a direction orthogonal to a longitudinal direction of the image bearing member, and each of the cartridge supported by the first support member and the cartridge supported by the second support member is removably mountable in a state in which the first support member and the second support member are located in the outside position.

13. An image forming apparatus according to claim 12, wherein the second support member is located on a movement locus of the first support member when the second support member is located in the inside position.

14. An image forming apparatus according to claim 12, wherein the second support member is located on a downstream side of the first support member in a moving direction in which the first support member is moved from the inside position to the outside position.

15. An image forming apparatus according to claim 12, wherein the second support member is moved to the outside position to move the first support member to the outside position.

16. An image forming apparatus according to claim 12, wherein the first support member supports a plurality of cartridges.

17. An image forming apparatus, comprising:

a plurality of image forming portions configured to form images of colors different from one another;

a first support member movable with respect to a main body of the image forming apparatus in a state in which the first support member supports a plurality of cartridges;

a second support member movable with respect to the main body independently of the first support member in a state in which the second support member supports a cartridge different from the plurality of cartridges supported by the first support member; and a guiding member disposed between the first support member and the second support member, wherein the plurality of cartridges supported by the first support member and the cartridge supported by the second support member are used in the plurality of image forming portions different from one another, respectively, each of the first support member and the second support member is movable between an inside position located inside of the main body and an outside position located outside of the main body, the plurality of cartridges supported by the first support member are removably mountable to the first support member in a state in which the first support member is located in the outside position and supported by the guiding member, the cartridge supported by the second support member is removably mountable to the second support member in a state in which the second support member is located in the outside position and supported by the guiding member, and the guiding member is provided with a first guiding portion guiding a movement of the first support member between the inside position and the outside position and a second guiding portion guiding a movement of the second support member between the inside position and the outside position.

18. An image forming apparatus according to claim 17, wherein each of the plurality of image forming portions comprises an image bearing member configured to bear an image, and each of the first support member and the second support member is moved between the inside position and the outside position along a longitudinal direction of the image bearing member.

19. An image forming apparatus according to claim 17, wherein the cartridge supported by the second support member is used in one of the plurality of image forming portions which forms an image in black.

20. An image forming apparatus according to claim 17, wherein each of the plurality of cartridges supported by the first support member and the cartridge supported by the second support member comprises an image bearing member configured to bear an image or a developer carrying member configured to develop a latent image.

* * * * *